US009964893B2

(12) United States Patent
Murata

(10) Patent No.: US 9,964,893 B2
(45) Date of Patent: May 8, 2018

(54) TONER CASE AND IMAGE FORMING APPARATUS

(71) Applicant: KYOCERA Document Solutions Inc., Osaka (JP)

(72) Inventor: Koji Murata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/266,236

(22) Filed: Sep. 15, 2016

(65) Prior Publication Data

US 2017/0293241 A1 Oct. 12, 2017

(30) Foreign Application Priority Data

Apr. 7, 2016 (JP) ..... 2016-077199

(51) Int. Cl.
*G03G 15/08* (2006.01)

(52) U.S. Cl.
CPC ..... *G03G 15/0881* (2013.01); *G03G 15/0889* (2013.01)

(58) Field of Classification Search
CPC ..... G03G 15/2039
See application file for complete search history.

(56) References Cited

U.S. PATENT DOCUMENTS

2006/0034642 A1* 2/2006 Taguchi ..... G03G 15/0868 399/258
2015/0338775 A1* 11/2015 Hosokawa ..... G03G 15/0868 399/258
2016/0091825 A1 3/2016 Oba et al.

FOREIGN PATENT DOCUMENTS

JP 09-197783 A 7/1997

OTHER PUBLICATIONS

Extended European Search Report (EESR) dated Aug. 10, 2017, from corresponding EP Appl No. 16188812.8, 9 pp.

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A toner case includes a case main body, a cover, and an agitating member. The case main body is configured to contain a toner and to rotate. The cover is configured to cover an opening part arranged at the case main body and to maintain a rotation stop state when the case main body rotates, the cover having a communication space which communicates with an inside space of the case main body via the opening part. The agitating member is configured to rotate integrally with the case main body and to agitate the toner in the communication space.

8 Claims, 20 Drawing Sheets

TONER CASE AND IMAGE FORMING APPARATUS

INCORPORATION BY REFERENCE

This application is based on and claims the benefit of priority from Japanese patent application No. 2016-077199 filed on Apr. 7, 2016, which is incorporated by reference in its entirety.

BACKGROUND

The present disclosure relates to a toner case and an image forming apparatus including the toner case.

An electrographic image forming apparatus performs a developing process by supplying a toner (a developer) from a developing device to an electrostatic latent image formed on a surface of an image carrier (for example, a photosensitive drum). The toner used for such a developing process is supplied from a toner case to the developing device. The above-mentioned toner case includes, for example, a case main body configured to contain a toner and to rotate.

SUMMARY

In accordance with an embodiment of the present disclosure, a toner case includes a case main body, a cover, and an agitating member. The case main body is configured to contain a toner and to rotate. The cover is configured to cover an opening part arranged at the case main body and to maintain a rotation stop state when the case main body rotates, the cover having a communication space which communicates with an inside space of the case main body via the opening part. The agitating member is configured to rotate integrally with the case main body and to agitate the toner in the communication space.

In accordance with an embodiment of the present disclosure, an image forming apparatus includes the toner case and an attachment part to which the toner case is attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an MFP 1 (an image forming apparatus) according to an embodiment of the present disclosure will be described. Arrows Fr, Rr, L, R, U and Lo optionally added to each drawing indicate a front side, a rear side, a left side, a right side, an upper side and a lower side of the MFP 1, respectively.

First, an outline of a structure of the MFP 1 will be described.

Figure 1:
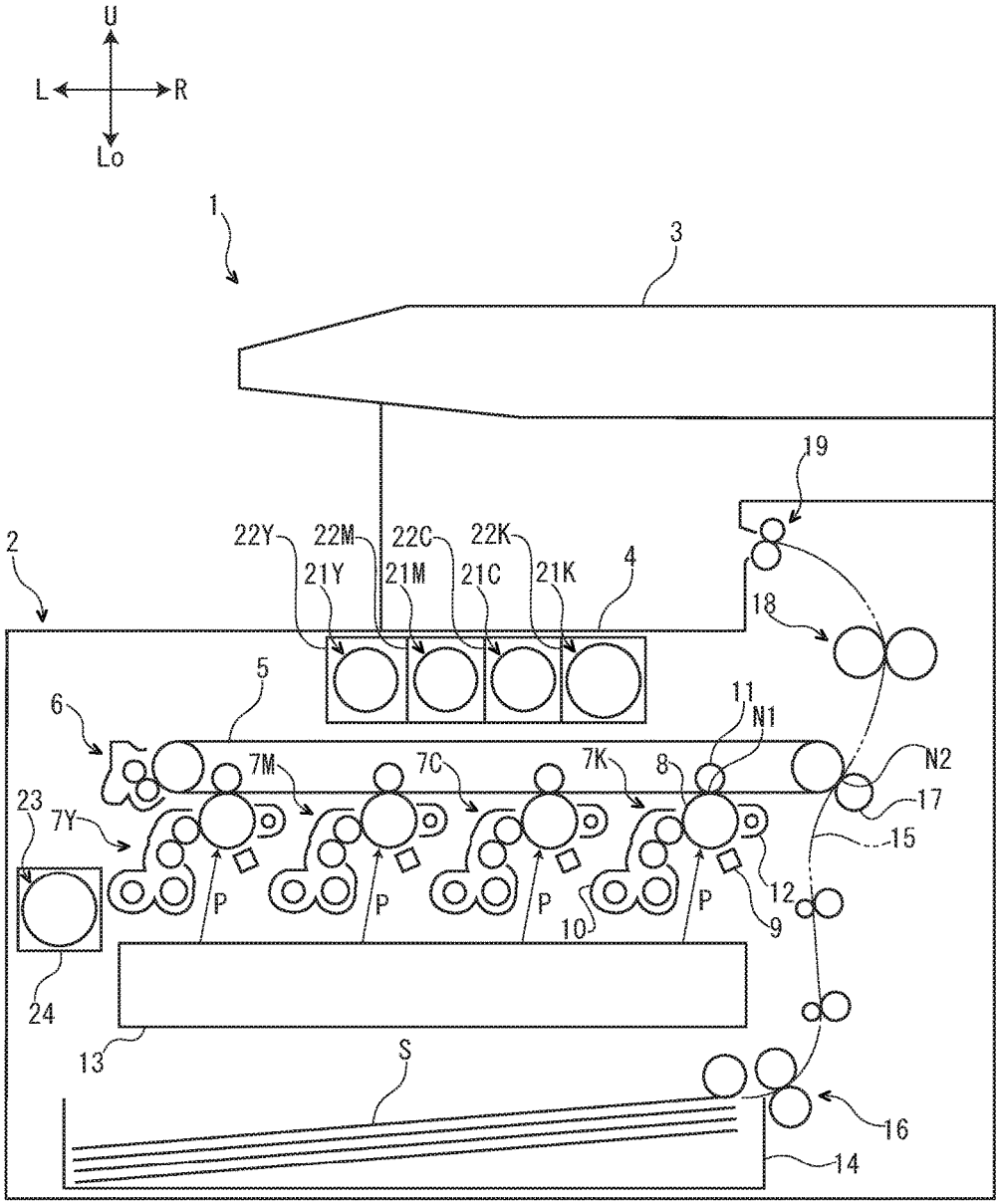
FIG. 1 is a schematic view showing an outline of a structure of an MFP (a multifunction peripheral) according to an embodiment of the present disclosure.

As shown in FIG. 1, the MFP 1 includes a box-formed MFP main body 2 (an apparatus main body). In an upper end part of the MFP main body 2, an image reading device 3 to read an original image is arranged. In an upper part of the MFP main body 2, a sheet ejecting tray 4 is arranged below the image reading device 3.

In a roughly center part of the MFP main body 2, an intermediate transfer belt 5 is housed. At a left end side of the intermediate transfer belt 5, a cleaning mechanism 6 is arranged.

In the roughly center part of the MFP main body 2, four image forming parts 7K, 7C, 7M, 7Y are housed below the intermediate transfer belt 5. Each image forming part 7K, 7C, 7M, 7Y corresponds to a toner (a developer) of black, cyan, magenta, and yellow, respectively. Each image forming part 7K, 7C, 7M, 7Y includes a photosensitive drum 8 (an image carrier), a charger 9, a developing device 10, a primary transfer roller 11, and a cleaning device 12. The primary transfer roller 11 sandwiches the intermediate transfer belt 5 with the photosensitive drum 8, so that a primary transfer nip N1 is formed between the intermediate transfer belt 5 and the photosensitive drum 8.

In a lower part of the MFP main body 2, an exposure device 13 is housed below the four image forming parts 7K, 7C, 7M, 7Y. In a lower end part of the MFP main body 2, a sheet feeding tray 14 is housed below the exposure device 13. In the sheet feeding tray 14, a sheet S (a recording medium) is accommodated.

At a right side part of the MFP main body 2, a conveying path 15 of the sheet S is arranged. At a lower end part (an upstream end part) of the conveying path 15, a sheet feeding part 16 is arranged. At an intermediate stream part of the conveying path 15, a secondary transfer roller 17 is arranged. Between the secondary transfer roller 17 and the intermediate transfer belt 5, a secondary transfer nip N2 is formed. At an upper part (a downstream part) of the conveying path 15, a fixing device 18 is arranged. At an upper end part (a downstream end part) of the conveying path 15, a sheet ejecting unit 19 is arranged.

In the upper part of the MFP main body 2, four toner containers 21K, 21C, 21M, 21Y (toner cases) are housed below the sheet ejecting tray 4. Each toner container 21K, 21C, 21M, 21Y contains the toner of black, cyan, magenta, and yellow, respectively. Each toner container 21K, 21C, 21M, 21Y is detachably attached to each toner supplying attachment part 22K, 22C, 22M, 22Y, respectively. In a left end part of the MFP main body 2, a waste toner bottle 23 (a toner case) is housed. The waste toner bottle 23 contains a waste toner. The waste toner bottle 23 is detachably attached to a waste toner collecting attachment part 24.

Next, an operation of the MFP 1 having such a structure will be described.

When an instruction to start printing is given to the MFP 1, an image forming operation is carried out as follows. First, a surface of the photosensitive drum 8 is electrically charged by the charger 9. Then, an electrostatic latent image is formed on the surface of the photosensitive drum 8 by a laser light (refer to an arrow P in FIG. 1) from the exposure device 13. Then, the toner supplied from each toner container 21K, 21C, 21M, 21Y is supplied from the developing device 10 to the photosensitive drum 8, so that the electrostatic latent image formed on the surface of the photosensitive drum 8 is developed and a toner image is carried by the photosensitive drum 8. The toner image is primarily transferred on a surface of the intermediate transfer belt 5 at the primary transfer nip N1. Such an operation is carried out in each image forming part 7K, 7C, 7M, 7Y, so that a full-color toner image is formed on the intermediate transfer belt 5. Incidentally, the waste toner remained on the surface of the photosensitive drum 8 after the image forming operation is collected by the cleaning device 12.

On the other hand, the sheet S picked from the sheet feeding tray 14 by the sheet feeding part 16 is conveyed to a downstream side of the conveying path 15 and enters the secondary transfer nip N2. In the secondary transfer nip N2, the full-color toner image formed on the intermediate transfer belt 5 is secondarily transferred to the sheet S. Incidentally, the waste toner remained on the surface of the intermediate transfer belt 5 after a secondary transfer operation is removed by the cleaning mechanism 6.

The sheet S to which the toner image is secondarily transferred is further conveyed to the downstream side of the conveying path 15 and enters the fixing device 18. In the fixing device 18, the toner image is fixed on the sheet S. The sheet S on which the toner image is fixed is ejected on the sheet ejecting tray 4 by the sheet ejecting unit 19.

Next, each toner container 21K, 21C, 21M, 21Y will be further described. Incidentally, an arrow I optionally assigned to FIG. 2 and each subsequent figure indicates an inside in a front and rear direction of each toner container 21K, 21C, 21M, 21Y, and an arrow O optionally assigned to FIG. 2 and each subsequent figure indicates an outside in the front and rear direction of each toner container 21K, 21C, 21M, 21Y.

Figure 2:
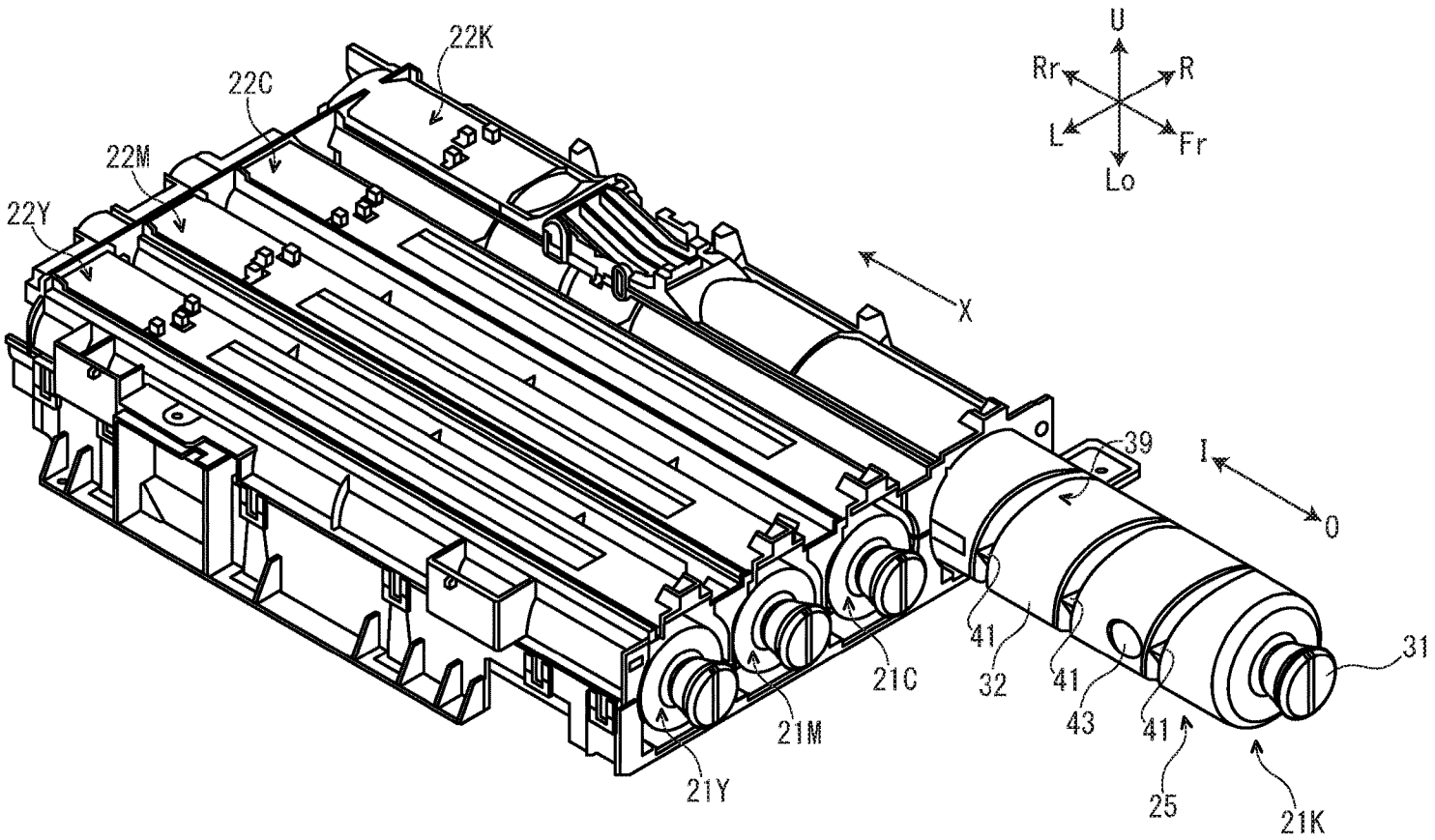
FIG. 2 is a perspective view showing a black toner container and each toner supplying attachment part according to the embodiment of the present disclosure.

As shown in FIG. 2, each toner container 21K, 21C, 21M, 21Y is attached to each toner supplying attachment part 22K, 22C, 22M, 22Y, respectively, along an attachment direction X directed from the front side to the rear side. Hereinafter, "a near side in the attachment direction" or "a far side in the attachment direction" indicates the near side or the far side in the attachment direction X. Incidentally, FIG. 2 shows a state that only the toner container 21K is being attached, and shows a state that attachment of the toner containers 21C, 21M, 21Y has been finished.

First, the toner container 21K (a black toner container) will be described.

Figure 3:
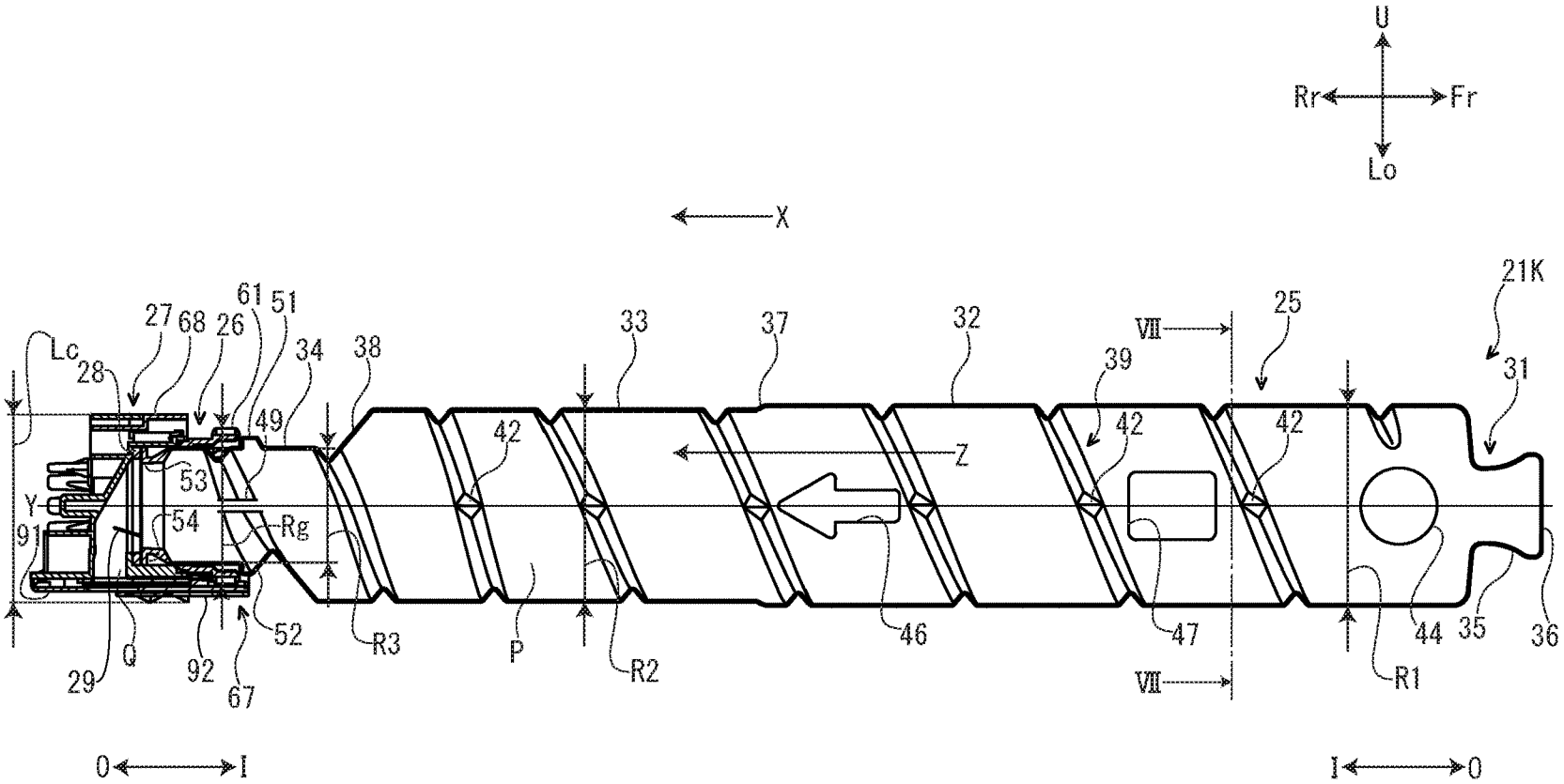
FIG. 3 is a sectional view showing the black toner container according to the embodiment of the present disclosure.
Figure 4:
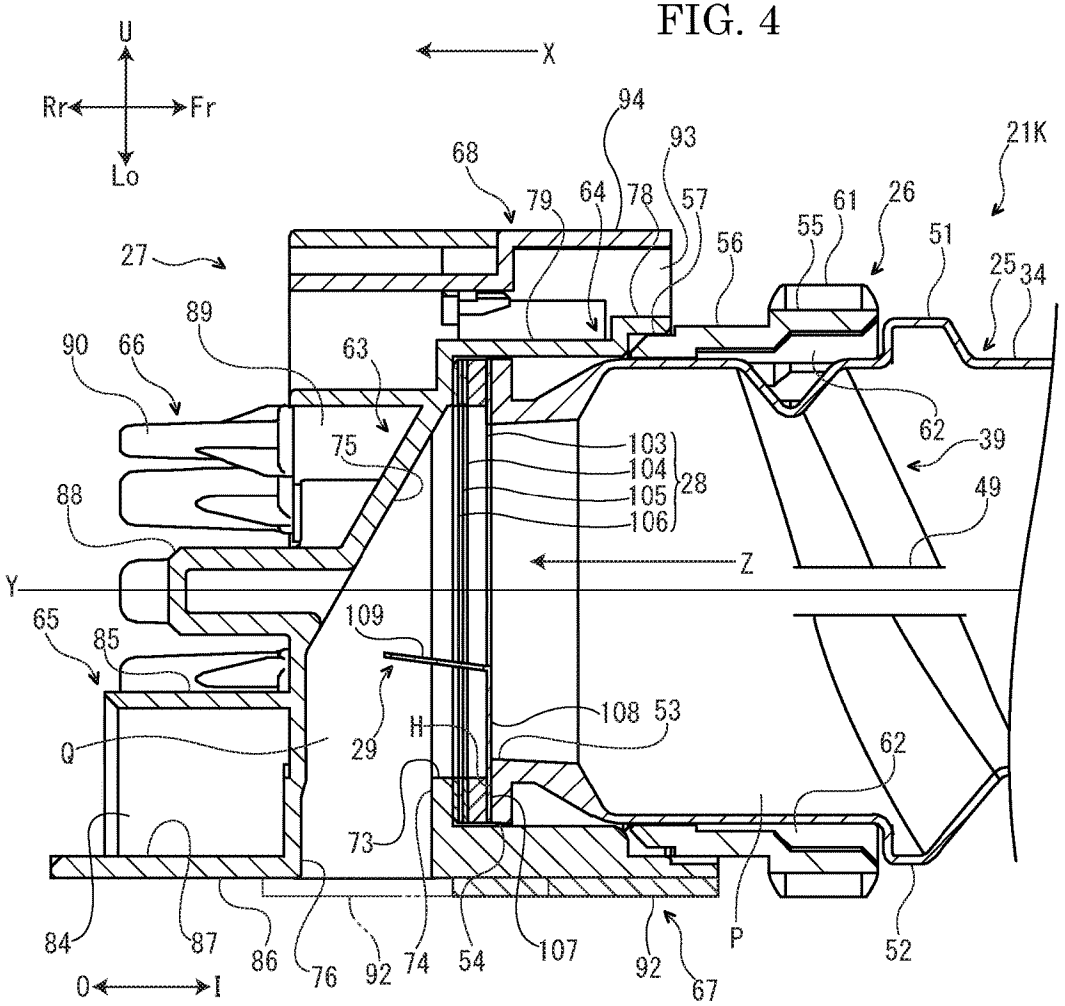
FIG. 4 is a sectional view showing a rear part of the black toner container according to the embodiment of the present disclosure.

As shown in FIGS. 3 and 4 and other figures, the toner container 21K includes a case main body 25, a transmission member 26 which is attached to a rear part of the case main body 25, a cover 27 which is arranged at a rear side of the transmission member 26, a seal member 28 which is accommodated in a substantially center part of the cover 27, and an agitating member 29 which is fixed to a rear end part of the case main body 25. Hereinafter, these members will be described in order.

First, the case main body 25 of the toner container 21K will be described.

As shown in FIG. 3 and other figures, the case main body 25 is formed in a cylindrical shape elongated in the front and rear direction. That is, the front and rear direction is a longitudinal direction of the case main body 25 in the present embodiment. The case main body 25 is configured to rotate around a rotation axis line Y extending in the front and rear direction. That is, the front and rear direction is a direction of the rotation axis line of the case main body 25 in the present embodiment.

A toner containing space P is formed inside the case main body 25. A black toner (not shown) is contained in the toner containing space P. Incidentally, an arrow Z in FIGS. 3 and 4 indicates a toner conveying direction (hereinafter, referred to as a "toner conveying direction Z") in the toner containing space P. Hereinafter, "an upstream side in the toner conveying direction" or "a downstream side in the toner conveying direction" indicates the upstream side or the downstream side in the toner conveying direction Z.

As shown in FIG. 3 and other figures, the case main body 25 includes a knob part 31, a large diameter cylinder part 32 which is arranged at a rear side (the downstream side in the toner conveying direction) of the knob part 31, a middle diameter cylinder part 33 which is arranged at a rear side (the downstream side in the toner conveying direction) of the large diameter cylinder part 32, and a small diameter cylinder part 34 which is arranged at a rear side (the downstream side in the toner conveying direction) of the middle diameter cylinder part 33.

The knob part 31 of the case main body 25 is arranged at a front end part (a near side end part in the attachment direction) of the case main body 25. The knob part 31 has the smallest outer diameter among each part of the case main body 25. An inside space of the knob part 31 communicates with an inside space of the large diameter cylinder part 32 so as to form a part of the toner containing space P. The knob part 31 includes a tubular part 35 extending along the attachment direction X, and a closing part 36 which closes a front end part (a near side end part in the attachment direction) of the tubular part 35. The tubular part 35 is formed in a cylindrical shape around the rotation axis line Y. The diameter of the tubular part 35 expands toward the front side (the near side in the attachment direction). The closing part 36 is formed in a disk shape.

The large diameter cylinder part 32, the middle diameter cylinder part 33, and the small diameter cylinder part 34 of the case main body 25 are formed in cylindrical shapes around the rotation axis line Y. The middle diameter cylinder part 33 is arranged between the large diameter cylinder part 32 and the small diameter cylinder part 34. An outer diameter R2 of the middle diameter cylinder part 33 is smaller than an outer diameter R1 of the large diameter cylinder part 32, and is larger than an outer diameter R3 of the small diameter cylinder part 34. Length of the middle diameter cylinder part 33 in the front and rear direction is shorter than length of the large diameter cylinder part 32 in the front and rear direction, and is longer than length of the small diameter cylinder part 34 in the front and rear direction.

On an outer circumferential face of the case main body 25, a substantially annular first stepped part 37 is arranged between the large diameter cylinder part 32 and the middle diameter cylinder part 33, and a spiral second stepped part 38 is arranged between the middle diameter cylinder part 33 and the small diameter cylinder part 34. A step size (i.e. a difference between the outer diameter R1 of the large diameter cylinder part 32 and the outer diameter R2 of the middle diameter part 33) of the first stepped part 37 is smaller than a step size (i.e. a difference between the outer diameter R2 of the middle diameter cylinder part 33 and the outer diameter R3 of the small diameter cylinder part 34) of the second stepped part 38.

A single spiral conveying rib 39 is continuously arranged on inner circumferential faces of the large diameter cylinder part 32, the middle diameter cylinder part 33, and the small diameter cylinder part 34 of the case main body 25. The conveying rib 39 protrudes in a substantially V shape from an inner circumferential face of the case main body 25 toward an inside in a radial direction.

Figure 5:
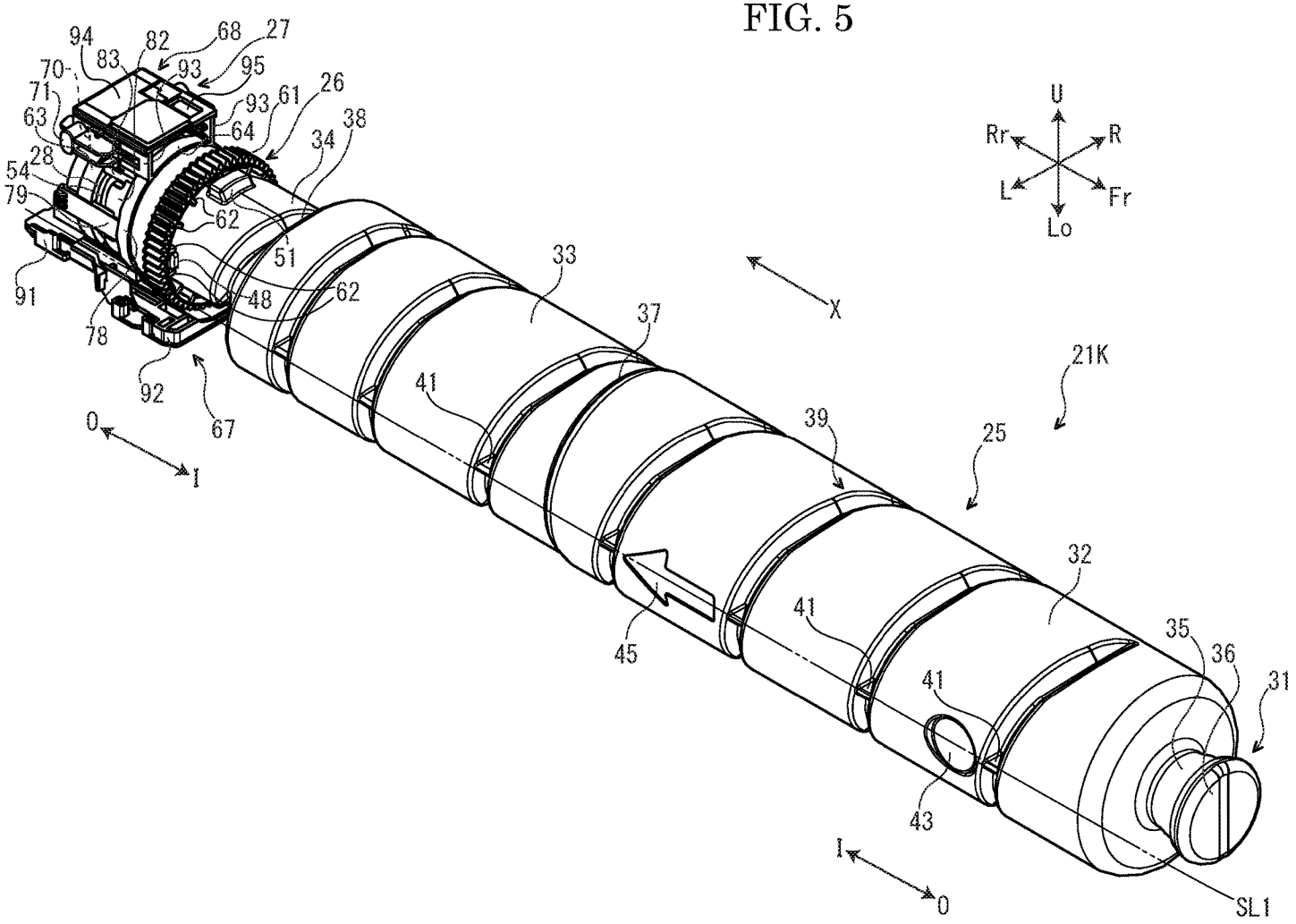
FIG. 5 is a perspective view seen from a left front side and showing the black toner container according to the embodiment of the present disclosure.
Figure 6:
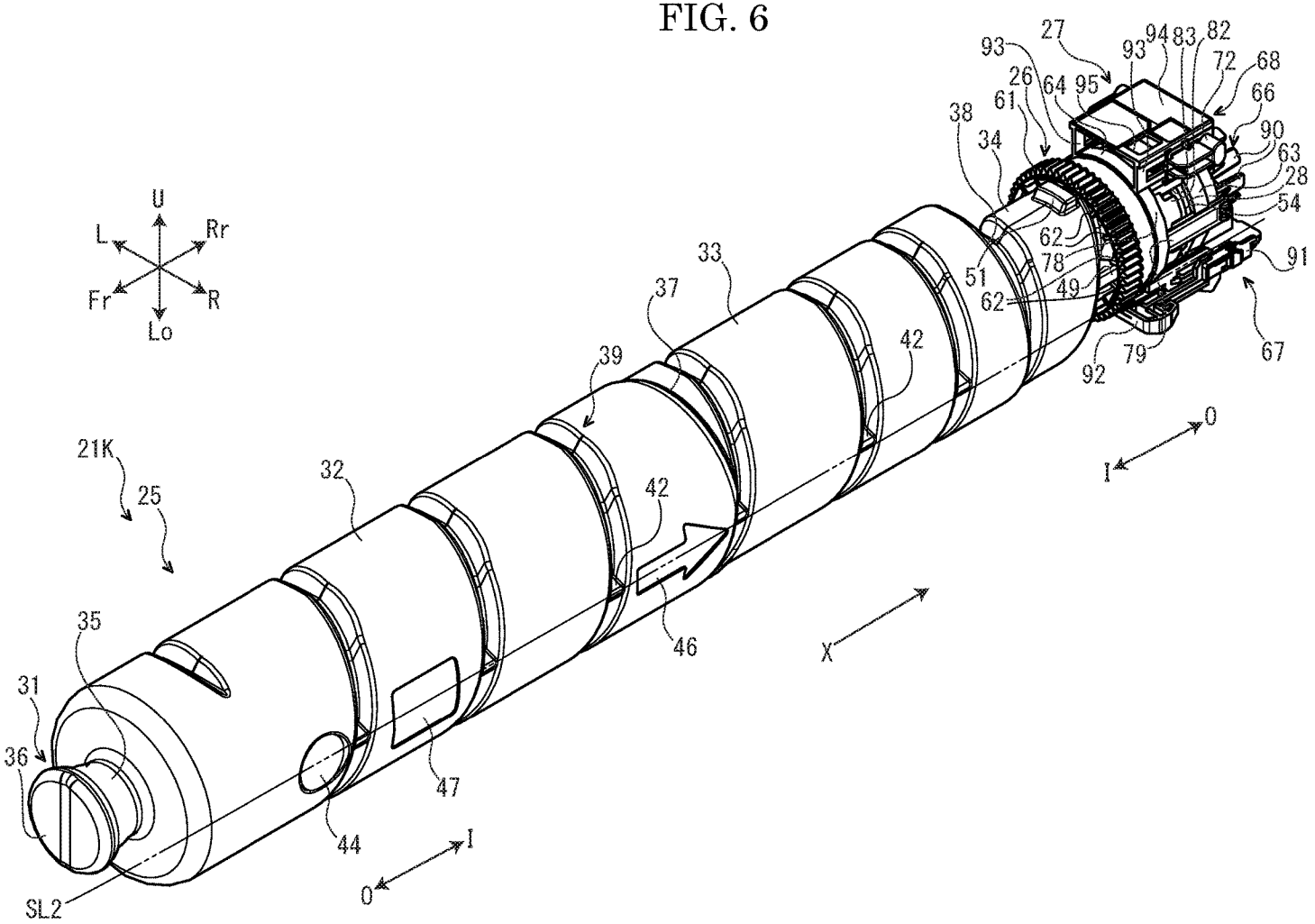
FIG. 6 is a perspective view seen from a right front side and showing the black toner container according to the embodiment of the present disclosure.
Figure 7:
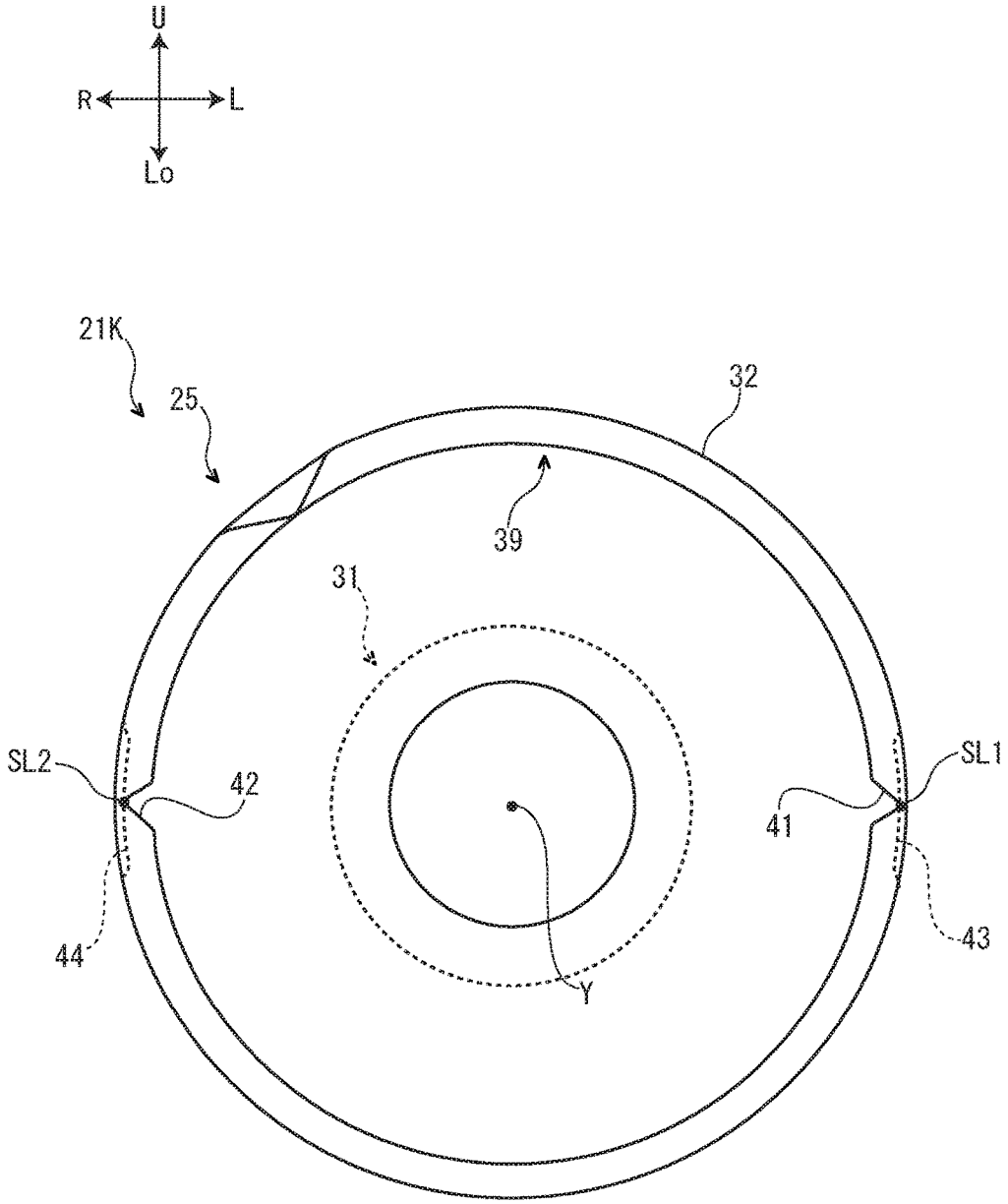
FIG. 7 is a sectional view showing a section along a VII-VII line of FIG. 3.

As shown in FIGS. 5 and 6 and other figures, the conveying rib 39 of the case main body 25 includes a plurality of first reinforcement parts 41 and a plurality of second reinforcement parts 42 at intervals in a spiral direction. Each first reinforcement part 41 and each second reinforcement part 42 are alternately arranged in the spiral direction of the conveying rib 39. Each first reinforcement part 41 and each second reinforcement part 42 protrude in substantially V shapes from the conveying rib 39 toward an outside in the radial direction. Each first reinforcement part 41 is located along a first standard straight line SL1 extending along the attachment direction X, and each second reinforcement part 42 is located along a second standard straight line SL2 extending along the attachment direction X. As shown in FIG. 7, the second standard straight line SL2 is located at an opposite side of the first standard straight line SL1 across the rotation axis line Y.

As shown in FIGS. 5 and 6 and other figures, at a front part of an outer circumferential face of the large diameter cylinder part 32 of the case main body 25 (a near side part in the attachment direction of the outer circumferential face of the entire case main body 25), a first finger placing part 43 is formed along the first standard straight line SL1 and a second finger placing part 44 is formed along the second standard straight line SL2. The first and second finger placing parts 43, 44 are arranged so that a worker who attaches the toner container 21K to the toner supplying attachment part 22K can place his/her fingers thereon. The first and second finger placing parts 43, 44 are composed of circular grooves. The first and second finger placing parts 43, 44 are located so that they do not overlap with the conveying rib 39.

As shown in FIGS. 5 and 6 and other figures, at a rear part of the outer circumferential face of the large diameter cylinder part 32 of the case main body 25 (a substantially center part of the outer circumferential face of the entire case main body 25), a first attachment direction pointing part 45 is formed along the first standard straight line SL1, and a second attachment direction pointing part 46 is formed along the second standard straight line SL2. The first and second attachment direction pointing parts 45, 46 are composed of arrow-shaped grooves pointing the attachment direction X. The first and second attachment direction pointing parts 45, 46 are located so that they do not overlap with the conveying rib 39.

As shown in FIG. 6 and other figures, at a substantially center part of the outer circumferential face of the large diameter cylinder part 32 of the case main body 25 (a near side part in the attachment direction of the outer circumferential face of the entire case main body 25), an indicator part 47 is formed along the second standard straight line SL2. The indicator part 47 is formed between the second finger placing part 44 and the second attachment direction pointing part 46. The indicator part 47 is composed of a substantially rectangular shape groove. For example, an indication (not shown) related to a material of the case main body 25 is written on the indicator part 47. The indicator part 47 is located so that it does not overlap with the conveying rib 39.

Figure 8:
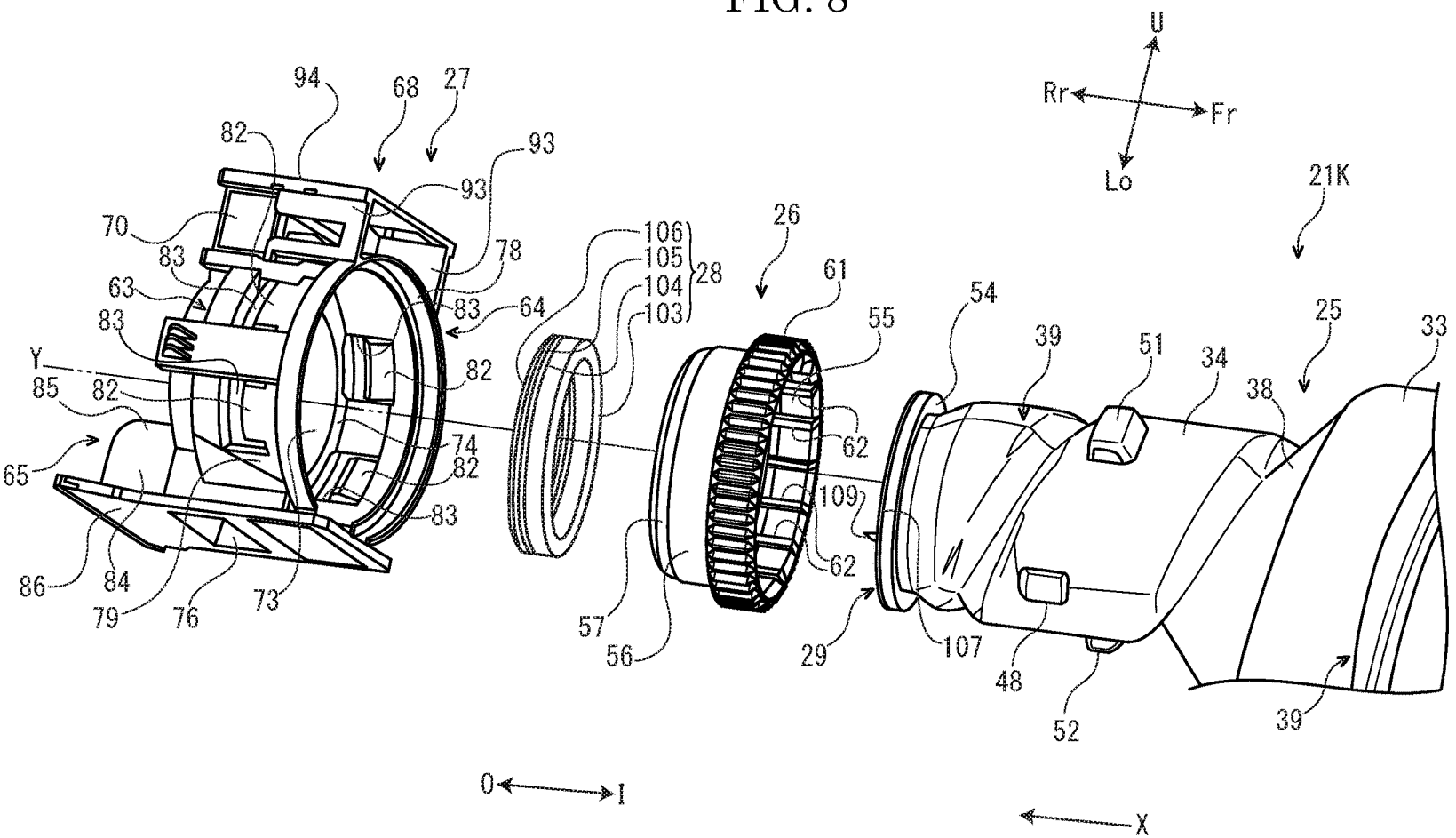
FIG. 8 is an exploded perspective view showing the black toner container according to the embodiment of the present disclosure.
Figure 9:
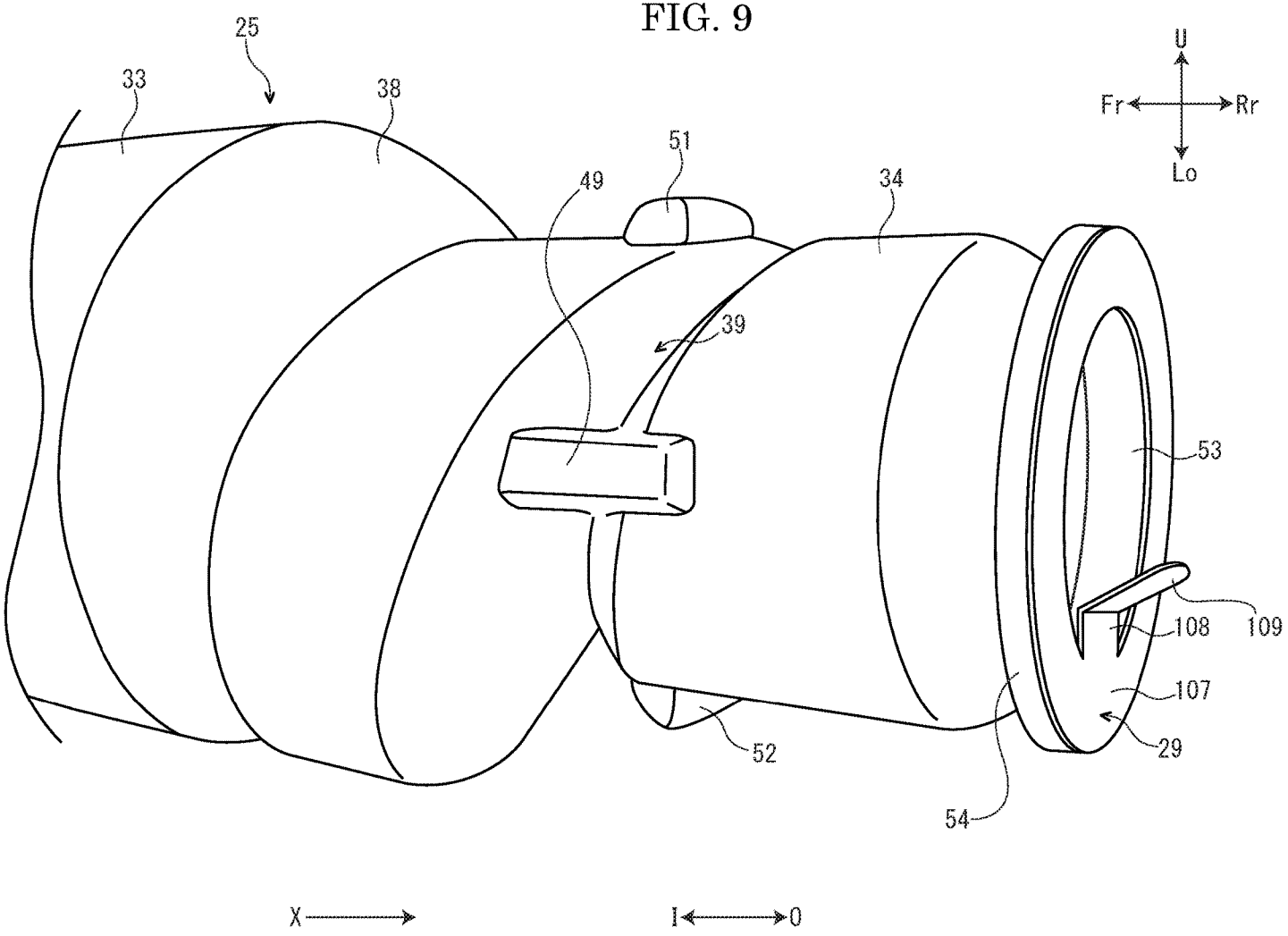
FIG. 9 is a perspective view showing a case main body and an agitating member of the black toner container according to the embodiment of the present disclosure.
Figure 10:
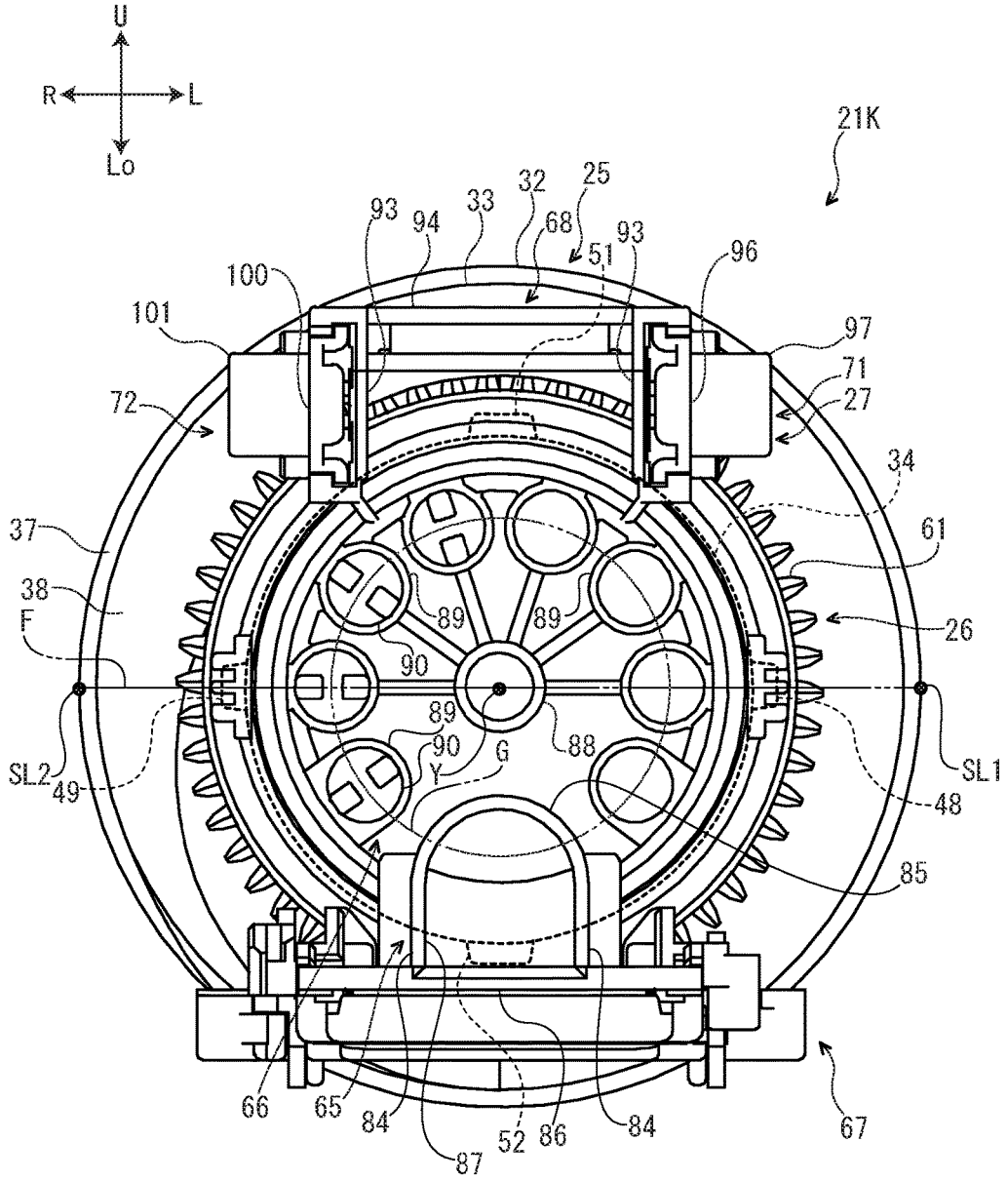
FIG. 10 is a rear view showing the black toner container according to the embodiment of the present disclosure.

As shown in FIG. 8 and other figures, a first engagement protrusion 48 (a first rotation restricting part) is arranged on an outer circumferential face of the small diameter cylinder part 34 of the case main body 25 (a far side part in the attachment direction of the outer circumferential face of the entire case main body 25). The first engagement protrusion 48 is located so that it does not overlap with the conveying rib 39. As shown in FIG. 9 and other figures, a second engagement protrusion (a second rotation restricting part) is formed on the outer circumferential face of the small diameter cylinder part 34 of the case main body 25 (a far side part in the attachment direction of the outer circumferential face of the entire case main body 25). The second engagement protrusion 49 is located so that it overlaps with the conveying rib 39. As shown in FIG. 10 and other figures, the first and second engagement protrusions 48, 49 are located on a plane F including the rotation axis line Y and the first and second standard straight lines SL1, SL2. The second engagement protrusion 49 is located at an opposite side of the first engagement protrusion 48 across the rotation axis line Y.

As shown in FIGS. 8 and 9 and other figures, a first protruding part 51 (a first movement restricting part) and a second protruding part 52 (a second movement restricting part) are formed on the outer circumferential face of the small diameter cylinder part 34 of the case main body 25 (a far side part in the attachment direction of the outer circumferential face of the entire case main body 25). The first and second protruding parts 51, 52 are located so that they do not overlap with the conveying rib 39. As shown in FIG. 10 and other figures, the second protruding part 52 is formed at an opposite side of the first protruding part 51 across the rotation axis line Y. The first and second protruding parts 51, 52 are located so that their circumferential positions are displaced 90 degrees from the first and second engagement protrusions 48, 49. That is, the first and second engagement protrusions 48, 49 and the first and second protruding parts 51, 52 are located so that their circumferential positions do not overlap with each other.

As shown in FIG. 9 and other figures, a circular opening part 53 is formed at a rear end part of the small diameter cylinder part 34 of the case main body 25 (a far side end part in the attachment direction and one end part in the front and rear direction of the entire case main body 25). An annular flange part 54 is formed at the rear end part of the small diameter cylinder part 34 and at an outer circumference of the opening part 53. The flange part 54 protrudes toward the outside in the radial direction.

Next, the transmission member 26 of the toner container 21K will be described.

As shown in FIG. 4 and other figures, the transmission member 26 is attached to the outer circumferential face of the small diameter cylinder part 34 of the case main body 25. The transmission member 26 is formed in a cylindrical shape around the rotation axis line Y.

The transmission member 26 includes a large diameter part 55, a middle diameter part 56 which is arranged at a rear side (the outside in the front and rear direction) of the large diameter part 55, and a small diameter part 57 which is arranged at a rear side (the outside in the front and rear direction) of the middle diameter part 56. The outer diameter of each part of the transmission member 26 becomes small in order of the large diameter part 55, the middle diameter part 56 and the small diameter part 57. A front end part of the large diameter part 55 (an inside end part in the front and rear direction of the entire transmission member 26) faces the first and second protruding parts 51, 52 of the case main body 25. A transmission gear 61 is arranged on the outer circumferential face of the large diameter part 55. As shown in FIG. 3 and other figures, a diameter Rg of the transmission gear 61 is smaller than the outer diameter R1 of the large diameter cylinder part 32 of the case main body 25 and the outer diameter R2 of the middle diameter cylinder part 33 of the case main body 25, and is larger than the outer diameter R3 of the small diameter cylinder part 34 of the case main body 25.

As shown in FIG. 8 and other figures, a plurality of engagement ribs 62 are formed on inner circumferential faces of the large diameter part 55 and the middle diameter part 56 of the transmission member 26 at intervals in the circumferential direction. A plurality of the engagement ribs 62, the number of which is ten to twenty, for example, are formed at equal intervals. A plurality of the engagement ribs 62 are provided over an entire area of an inner circumferential face of the transmission member 26. A plurality of the engagement ribs 62 extend along the front and rear direction. As shown in FIG. 5 and other figures, the first engagement protrusion 48 of the case main body 25 is inserted into the interval between one pair of the engagement ribs 62 among a plurality of the engagement ribs 62. As shown in FIG. 6 and other figures, the second engagement protrusion 49 of the case main body 25 is inserted into the interval between another pair of the engagement ribs 62 different from the one pair of the engagement ribs 62 among a plurality of the engagement ribs 62. According to such a configuration, a rotation of the transmission member 26 with respect to the case main body 25 is restricted. Incidentally, the engagement ribs 62 other than the above-mentioned two pairs of the engagement ribs 62 (the engagement ribs 62 arranged so that the first and second engagement protrusions 48, 49 are not inserted into the intervals thereof) function as reinforcement parts which reinforce the transmission member 26.

Next, the cover 27 of the toner container 21K will be described.

As shown in FIG. 3 and other figures, the cover 27 covers the opening part 53 formed in the small diameter cylinder part 34 of the case main body 25. The length Lc of the cover 27 in an upper and lower direction is shorter than the outer diameter R1 of the large diameter cylinder part 32 of the case main body 25 and the outer diameter R2 of the middle diameter cylinder part 33 of the case main body 25, and is longer than the outer diameter R3 of the small diameter cylinder part 34 of the case main body 25.

As shown in FIGS. 4 to 6 and other figures, the cover 27 includes a main body part 63, a holding part 64 which extends from the main body part 63 toward the front side (the inside in the front and rear direction and the near side in the attachment direction), an engagement cylinder part 65 which protrudes from a rear lower part of the main body part 63 to the rear side (the outside in the front and rear direction and the far side in the attachment direction), a cover side restricting part 66 which is arranged at an upper side of the engagement cylinder part 65, a cover side shutter 67 which is arranged at a lower side of the main body part 63, the holding part 64, and the engagement cylinder part 65, a supporting part 68 which extends from the main body part and the holding part 64 toward the upper side, a display part 70 and a first lever 71 (see FIG. 5 and other figures) which are arranged at a left side of the supporting part 68, and a second lever 72 (see FIG. 6 and other figures) which is arranged at a right side of the supporting part 68.

As shown in FIG. 4 and other figures, a communication space Q which communicates with the toner containing space P of the case main body 25 via the opening part 53 of the case main body 25 is formed inside the main body part 63 of the cover 27. The communication space Q extends along the upper and lower direction. The main body part 63 includes a toner introducing port 73 which is formed at an upper front side of the communication space Q. The main body part 63 includes an annular pedestal part 74 at a circumference of the toner introducing port 73. The main body part 63 includes an inclined wall part 75 closer to a rear side (the outside in the front and rear direction) than the toner introducing port 73. The inclined wall part 75 is inclined to the lower side toward the rear side (the outside in the front and rear direction). The main body part 63 includes a toner discharging port 76 at a lower end side of the communication space Q.

The holding part 64 of the cover 27 is formed in a substantially cylindrical shape around the rotation axis line Y. The holding part 64 and the first and second protruding parts 51, 52 of the case main body 25 sandwich the transmission member 26. According to such a configuration, a movement in the front and rear direction of the transmission member 26 with respect to the case main body 25 is restricted, and the transmission member 26 is prevented from dropping from the case main body 25.

The holding part 64 of the cover 27 includes a large diameter frame part 78 and a small diameter frame part 79 which is arranged at a rear side (the outside in the front and rear direction) of the large diameter frame part 78. An outer diameter of the large diameter frame part 78 is larger than an outer diameter of the small diameter frame part 79. The small diameter part 57 of the transmission member 26 is inserted into an inside in the radial direction of the large diameter frame part 78. A front end part of the large diameter frame part 78 faces a rear end part of the middle diameter part 56 of the transmission member 26, and a front end part of the small diameter frame part 79 faces a rear end part of the small diameter part 57 of the transmission member 26.

As shown in FIG. 8 and other figures, the small diameter frame part 79 of the holding part 64 of the cover 27 has four locking parts 82 at upper and lower parts of the left side and the right side. As shown in FIGS. 5 and 6 and other figures, each locking part 82 locks the flange part 54 (the far side end part in the attachment direction and the one end part in the front and rear direction) of the case main body 25. According to this, the holding part 64 holds the flange part 54 of the case main body 25. The small diameter frame part 79 has window parts 83 at the rear side (the outside in the front and rear direction) of the locking parts 82.

As shown in FIG. 10 and other figures, the engagement cylinder part 65 of the cover 27 includes a pair of left and right sidewall parts 84, an upper wall part 85 which connects upper end parts of a pair of the left and right sidewall parts 84, and a lower wall part 86 which connects lower end parts of a pair of the left and right sidewall parts 84. A pair of the left and right sidewall parts 84 are formed in substantially vertical flat shapes and face each other. The upper wall part 85 is curved in an arc shape toward the upper side. The lower wall part 86 is formed in a substantially horizontal flat shape.

A recess part 87 (a cover side engagement part) is formed inside the engagement cylinder part 65 of the cover 27. As shown in FIG. 4 and other figures, the recess part 87 is formed in a rear face (a far side face in the attachment direction and an outside face in the front and rear direction) of the cover 27. The recess part 87 extends along the attachment direction X and the front and rear direction.

As shown in FIG. 10 and other figures, the cover side restricting part 66 of the cover 27 includes a fitting protrusion 88, a plurality of (eight in the present embodiment) base parts 89 which are formed at an outer circumference of the fitting protrusion 88, and a plurality of (four in the present embodiment) restricting plates 90 which are arranged at a part of a plurality of base parts 89. The fitting protrusion 88 is formed on the rotation axis line Y. Each base part 89 is arranged on a circumference G around the fitting protrusion 88, and a lower end part of this circumference G overlaps with the recess part 87 of the engagement cylinder part 65. The four right base parts 89 of the eight base parts 89 of the toner container 21K according to the present embodiment is provided with the restricting plates 90. By contrast with this, the toner container 21K whose place of destination is different from that of the toner container 21K according to the present embodiment differs from the present embodiment in a combination of the base parts 89 provided with the restricting plates 90. Incidentally, the restricting plates 90 is arranged at a part of a plurality of the base parts 89 by providing the restricting plates 90 to all of a plurality of the base parts 89 and then removing a part of the restricting plates 90 or by fixing the restricting plates 90 only to a part of a plurality of the base parts 89, for example.

As shown in FIGS. 5 and 6 and other figures, the cover side shutter 67 is formed in a shape elongated in the front and rear direction. The cover side shutter 67 includes a fixed piece 91, and a movable piece 92 which is supported by the fixed piece 91. Incidentally, FIG. 4 does not show the fixed piece 91 and schematically shows the movable piece 92. The movable piece 92 is configured to move along the front and rear direction between an opening position (see a solid line in FIG. 4) to open the toner discharging port 76 of the main body part 63 and a closing position (see a two-dot chain line in FIG. 4) to close the toner discharging port 76 of the main body part 63.

As shown in FIGS. 5 and 6 and other figures, the supporting part 68 of the cover 27 includes a pair of left and right supporting plates 93, and a connecting plate 94 which connects upper end parts of a pair of the left and right supporting plates 93. A pair of the left and right supporting plates 93 face each other. A lower end part of each supporting plate 93 is connected with the main body part 63 and the holding part 64 of the cover 27. A through hole 95 is formed at a front right corner part of the connecting plate 94.

Figure 11A:
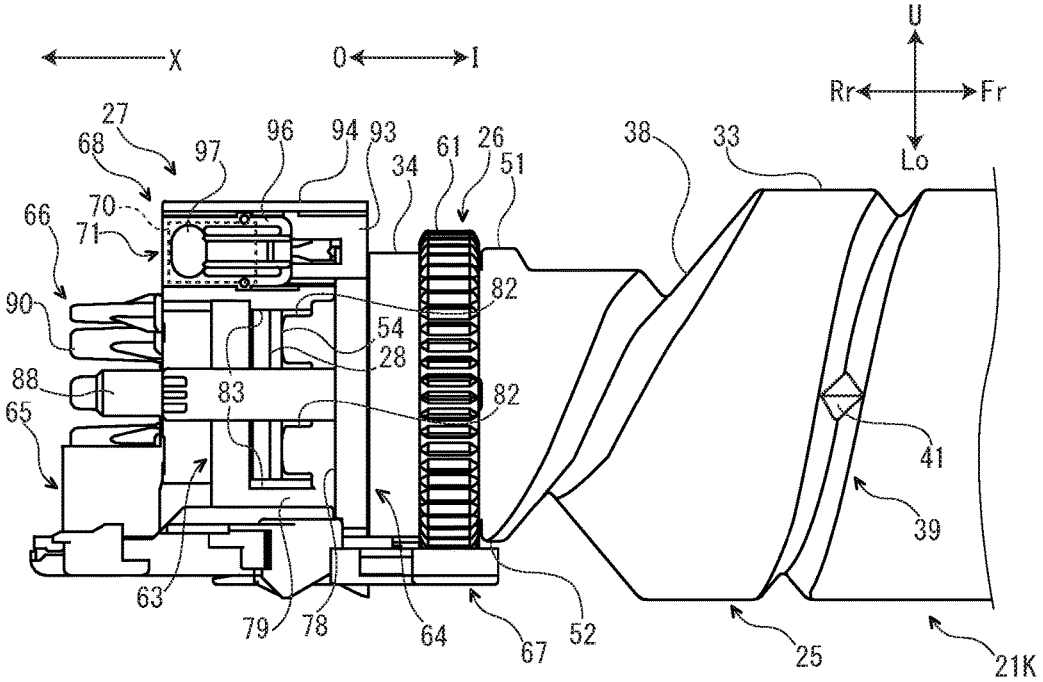
FIG. 11A is a side view showing a state that a first lever is in a first position, in the black toner container according to the embodiment of the present disclosure.
Figure 11B:
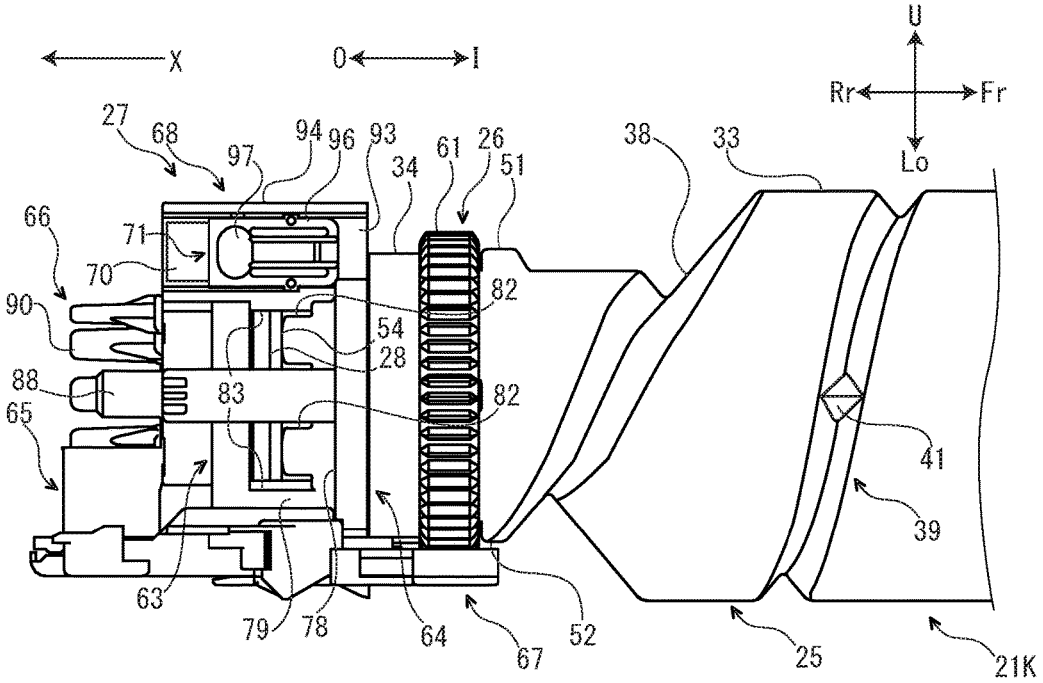
FIG. 11B is a side view showing a state that the first lever is in a second position, in the black toner container according to the embodiment of the present disclosure.

As shown in FIGS. 11A and 11B and other figures, the display part 70 of the cover 27 is composed of a rectangular label. A back face of the display part 70 is adhered to a left side face of the left supporting plate 93 of the supporting part 68. A color different from a color of members (e.g. the main body part 63, the holding part 64, the supporting part 68, and the first lever 71 of the cover 27) around the display part 70 is applied to a surface of the display part 70. In the present embodiment, red is applied to the surface of the display part 70, and black is applied to the members around the display part 70.

The first lever 71 of the cover 27 includes a first base plate 96, and a first protrusion piece 97 which protrudes from a rear part of the first base plate 96 toward the left side (the outside in the left and right direction). The first lever 71 is supported by the left supporting plate 93 so that the first lever 71 moves along a left side face of the left supporting plate 93 of the supporting part 68. The first lever 71 is configured to move along the front and rear direction between a first position (see FIG. 11A) and a second position (see FIG. 11B) closer to the front side than the first position.

Figure 12A:
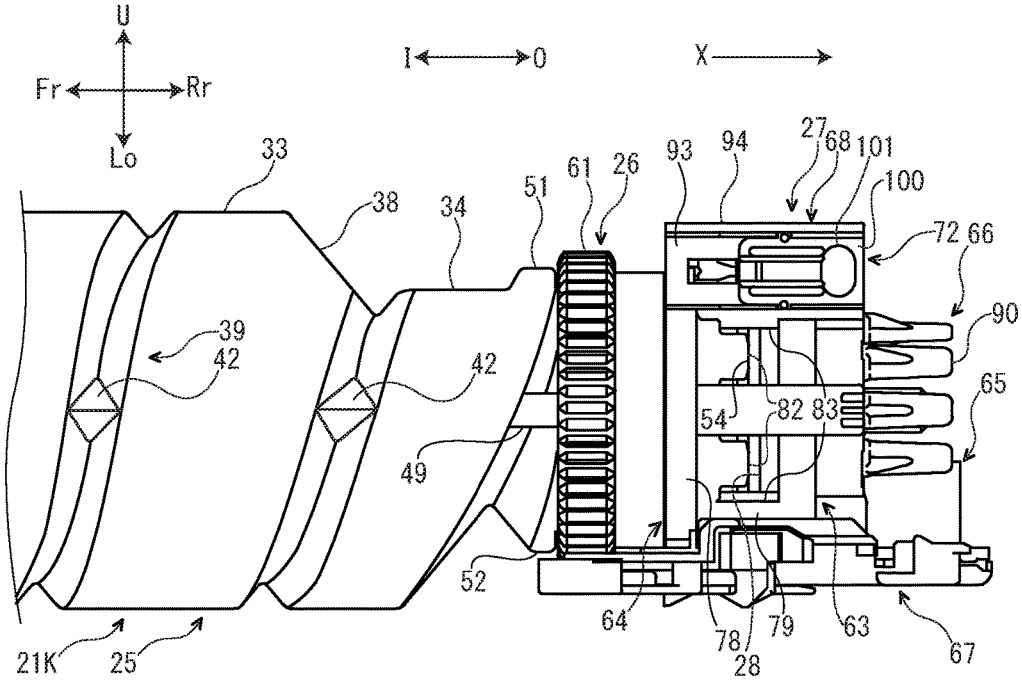
FIG. 12A is a side view showing a state that a second lever is in a third position, in the black toner container according to the embodiment of the present disclosure.
Figure 12B:
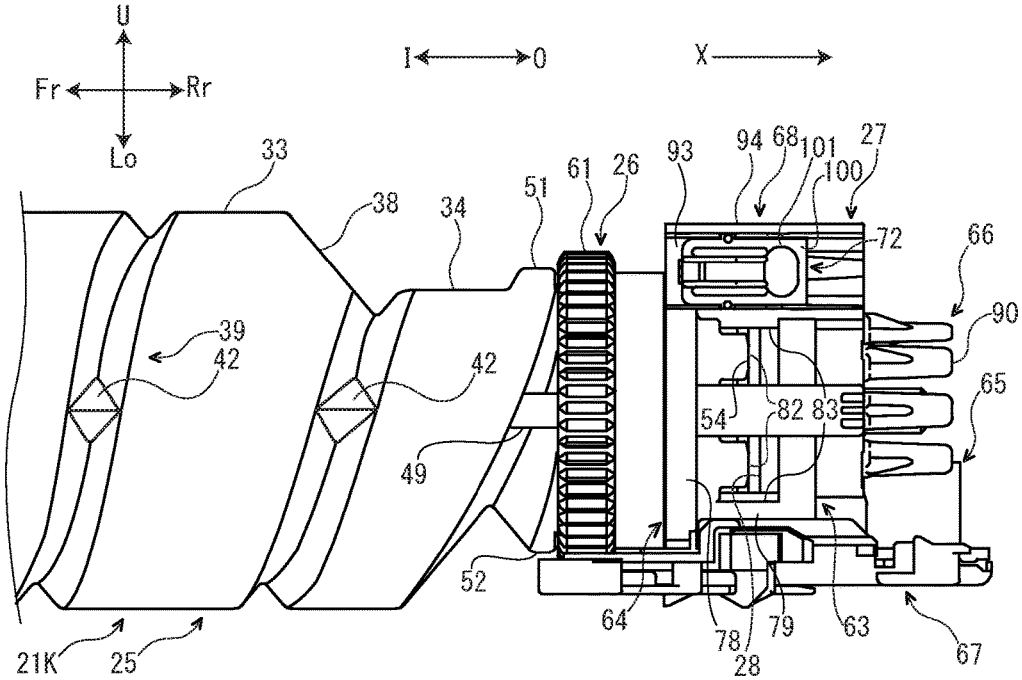
FIG. 12B is a side view showing a state that the second lever is in a fourth position, in the black toner container according to the embodiment of the present disclosure.

As shown in FIGS. 12A and 12B and other figures, the second lever 72 of the cover 27 includes a second base plate 100, and a second protrusion piece 101 which protrudes from a rear part of the second base plate 100 toward the right side (the outside in the left and right direction). The second lever 72 is supported by the right supporting plate 93 so that the second lever 72 moves along a right side face of the right supporting plate 93 of the supporting part 68. The second lever 72 is configured to move along the front and rear direction between a third position (see FIG. 12A) and a fourth position (see FIG. 12B) closer to the front side than the third position.

Next, the seal member 28 of the toner container 21K will be described.

As shown in FIG. 4 and other figures, the seal member 28 is arranged at the front side (the inside in the front and rear direction) of the main body part 63 of the cover 27 and at the inside in the radial direction of the holding part 64 of the cover 27. The seal member 28 is formed in an annular shape. The seal member 28 is interposed between the flange part 54 of the case main body 25 and the pedestal part 74 of the main body part 63 of the cover 27 in a compressed state. The seal member 28 is fixed to a front face (an inside face in the front and rear direction) of the pedestal part 74.

As shown in FIGS. 4 and 8 and other figures, the seal member 28 includes an elastic layer 103, a first adhesive layer 104 which is arranged at a rear side (the outside in the front and rear direction) of the elastic layer 103, a base material layer 105 which is arranged at a rear side (the outside in the front and rear direction) of the first adhesive layer 104, and a second adhesive layer 106 which is arranged at a rear side (the outside in the front and rear direction) of the base material layer 105. The elastic layer 103 is composed of polyurethane foam which is an elastic material, for example. The first adhesive layer 104 is composed of a double-sided tape, for example, so as to adhere the elastic layer 103 and the base material layer 105. The base material layer 105 is composed of a material having a higher rigidity than the polyurethane foam which composes the elastic layer 103. The base material layer 105 is composed of a resin film, for example. The second adhesive layer 106 is composed of a double-sided tape, for example, so as to adhere the base material layer 105 and the pedestal part 74 of the main body part 63 of the cover 27.

As shown in FIGS. 11A, 11B, 12A and 12B and other figures, a part of the seal member 28 is exposed to the outside via the window parts 83 formed in the holding part 64 of the cover 27. Hence, the part of the seal member 28 can be visually checked from the outside.

Next, the agitating member 29 of the toner container 21K will be described.

As shown in FIGS. 4 and 9 and other figures, the agitating member 29 is arranged closer to the rear side (the outside in the front and rear direction) than the case main body 25. The agitating member 29 is composed of a material having a lower friction coefficient than that of the case main body 25. The agitating member 29 is composed of a resin film, for example.

The agitating member 29 includes a fixed part 107, an extending part 108 which extends from the fixed part 107 toward the inside in the radial direction, and an inserted part 109 which extends from an inside end part in the radial direction of the extending part 108 toward the rear side (the outside in the front and rear direction and the side of the communication space Q).

The fixed part 107 of the agitating member 29 is formed in an annular shape. A front face (an inside face in the front and rear direction) of the fixed part 107 is fixed to the rear end part of the small diameter cylinder part 34 of the case main body 25 (the one end part in the front and rear direction of the entire case main body 25). A fixing face H on which the rear end part of the small diameter cylinder part 34 of the case main body 25 and the fixed part 107 are fixed is vertical to the rotation axis line Y. A rear face (an outside face in the front and rear direction) of the fixed part 107 comes into contact with a front face (an inside face in the front and rear direction) of the elastic layer 103 of the seal member 28. Thus, the fixed part 107 is interposed between the rear end part of the small diameter cylinder part 34 of the case main body 25 and the elastic layer 103 of the seal member 28.

The inserted part 109 of the agitating member 29 protrudes toward the rear side (the outside in the front and rear direction and the side of the communication space Q) with respect to the fixed part 107 and the extending part 108. A base end part of the inserted part 109 is bent at an obtuse angle from the inside end part in the radial direction of the extending part 108 to the rear side (the outside in the front and rear direction and the side of the communication space Q) so as to penetrate the seal member 28. A distal end part of the inserted part 109 is inserted into the communication space Q of the main body part 63 of the cover 27. The distal end part of the inserted part 109 is located right above the toner discharging port 76 formed in the main body part 63 of the cover 27. The distal end part of the inserted part 109 is curved in an arc shape.

Next, the toner containers 21C (cyan toner container), 21M (magenta toner container) and 21Y (yellow toner container) will be described. Incidentally, each toner container 21C, 21M, 21Y employs the same configuration, and therefore only the toner container 21C will be described below and descriptions of the toner containers 21M, 21Y will be omitted.

Figure 13:
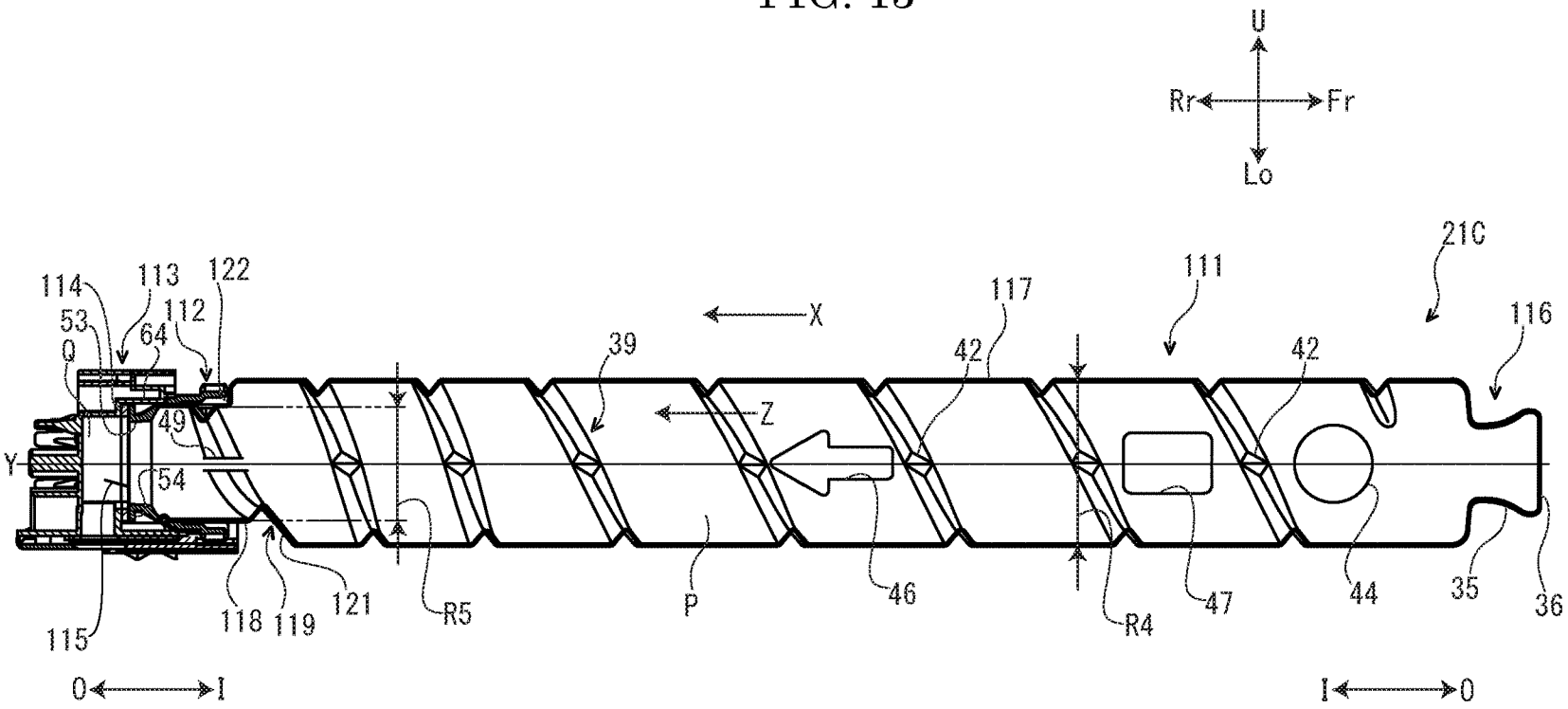
FIG. 13 is a sectional view showing a cyan toner container according to the embodiment of the present disclosure.

As shown in FIG. 13 and other figures, the toner container 21C includes a case main body 111, a transmission member 112 which is attached to a rear part of the case main body 111, a cover 113 which is arranged at a rear side of the transmission member 112, a seal member 114 which is accommodated at a substantially center part of the cover 113, and an agitating member 115 which is fixed to a rear end part of the case main body 111.

Configurations of the transmission member 112, the seal member 114 and the agitating member 115 of the toner container 21C are the same as configurations of the transmission member 26, the seal member 28 and the agitating member 29 of the toner container 21K, and therefore will not be described. Further, a configuration of the cover 113 of the toner container 21C is the same as a configuration of the cover 27 of the toner container 21K except that the cover 113 does not include the first and second levers 71, 72, and therefore will not be described. Hence, only the case main body 111 of the toner container 21C will be described below.

The case main body 111 includes a knob part 116, a large diameter cylinder part 117 which is arranged at a rear side (the downstream side in the toner conveying direction) of the knob part 116, and a small diameter cylinder part 118 which is arranged at a rear side (the downstream side in the toner conveying direction) of the large diameter cylinder part 117. An outer diameter R4 of the large diameter cylinder part 117 is larger than an outer diameter R5 of the small diameter cylinder part 118.

As shown in FIG. 13 and other figures, a stepped part 119 (a movement restricting part) is arranged on an outer circumferential face of the case main body 111 between the large diameter cylinder part 117 and the small diameter cylinder part 118. The stepped part 119 includes a spiral part 121, and a plane part 122 which is arranged at a rear side (the downstream side in the toner conveying direction) of the spiral part 121. The spiral part 121 is formed in a spiral shape inclined with respect to the front and rear direction. The plane part 122 is formed in a planar shape vertical to the front and rear direction. A part (an upper part in FIG. 13) of the plane part 122 and the holding part 64 of the cover 113 sandwich the transmission member 112. According to such a configuration, a movement in the front and rear direction of the transmission member 112 with respect to the case main body 111 is restricted, and the transmission member 112 is prevented from dropping from the case main body 111. The configuration of the case main body 111 other than the above is the same as the case main body 25 of the toner container 21K, and therefore will not be described.

Next, the toner supplying attachment parts 22K, 22C, 22M, 22Y will be described.

As shown in FIG. 2 and other figures, the toner supplying attachment parts 22K, 22C, 22M, 22Y are aligned in the left and right direction. Each of the toner supplying attachment parts 22K, 22C, 22M, 22Y is formed in a tubular shape extending in the front and rear direction. An inner diameter of the toner supplying attachment part 22K is larger than inner diameters of the toner supplying attachment parts 22C, 22M, 22Y.

Figure 14:
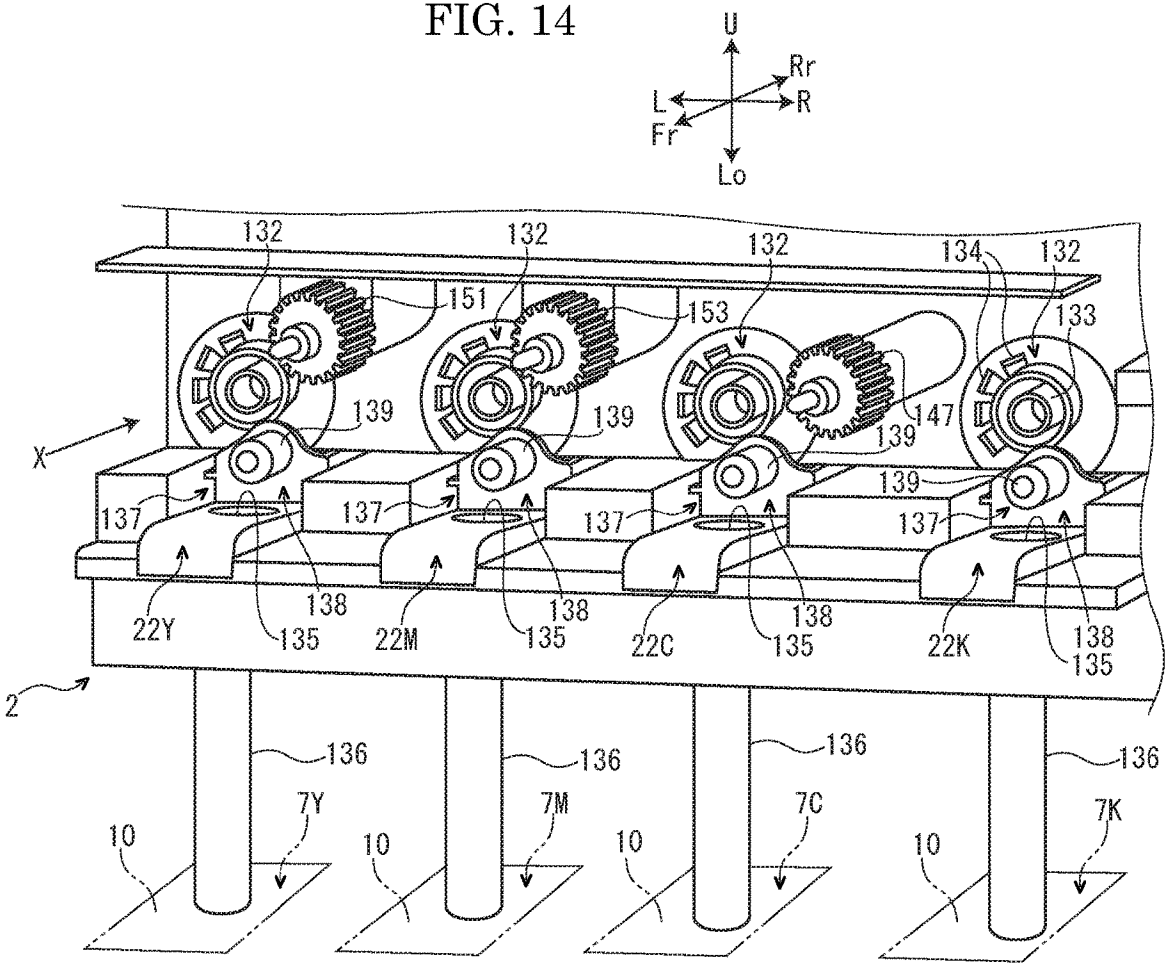
FIG. 14 is a perspective view showing a rear part of each toner supplying attachment part according to the embodiment of the present disclosure.

As shown in FIG. 14 and other figures, an attachment part side restricting part 132 is arranged at a rear end part of each toner supplying attachment part 22K, 22C, 22M, 22Y. The attachment part side restricting part 132 includes a cylindrical fitted part 133, and a plurality of (e.g. four) restricting pieces 134 which are arranged at an outer circumference of the fitted part 133. The four restricting pieces 134 are arranged at a left side of a center of the fitted part 133 in each toner supplying attachment part 22K, 22C, 22M, 22Y according to the present embodiment. By contrast with this, positions at which a plurality of restricting pieces 134 are arranged in each toner supplying attachment part 22K, 22C, 22M, 22Y of the MFP main body 2 whose place of destination is different from that of the MFP main body 2 according to the present embodiment are different from those of the present embodiment.

A toner supplying port 135 is formed in a rear part of a lower face of each toner supplying attachment part 22K, 22C, 22M, 22Y. The toner supplying port 135 of each toner supplying attachment part 22K, 22C, 22M, 22Y communicates with an inside space of the developing device 10 of each image forming part 7K, 7C, 7M, 7Y via a supply tube 136 extending along the upper and lower direction.

An attachment part side shutter 137 is arranged at a rear part of each toner supplying attachment part 22K, 22C, 22M, 22Y. The attachment part side shutter 137 includes a shutter main body 138 and a boss 139 (an attachment part side engagement part) which is arranged at a front side (the near side in the attachment direction) of the shutter main body 138.

The attachment part side shutter 137 of each toner supplying attachment part 22K, 22C, 22M, 22Y is configured to move along the front and rear direction between an opening position at which the shutter main body 138 opens the toner supplying port 135 and a closing position at which the shutter main body 138 closes the toner supplying port 135.

Figure 15:
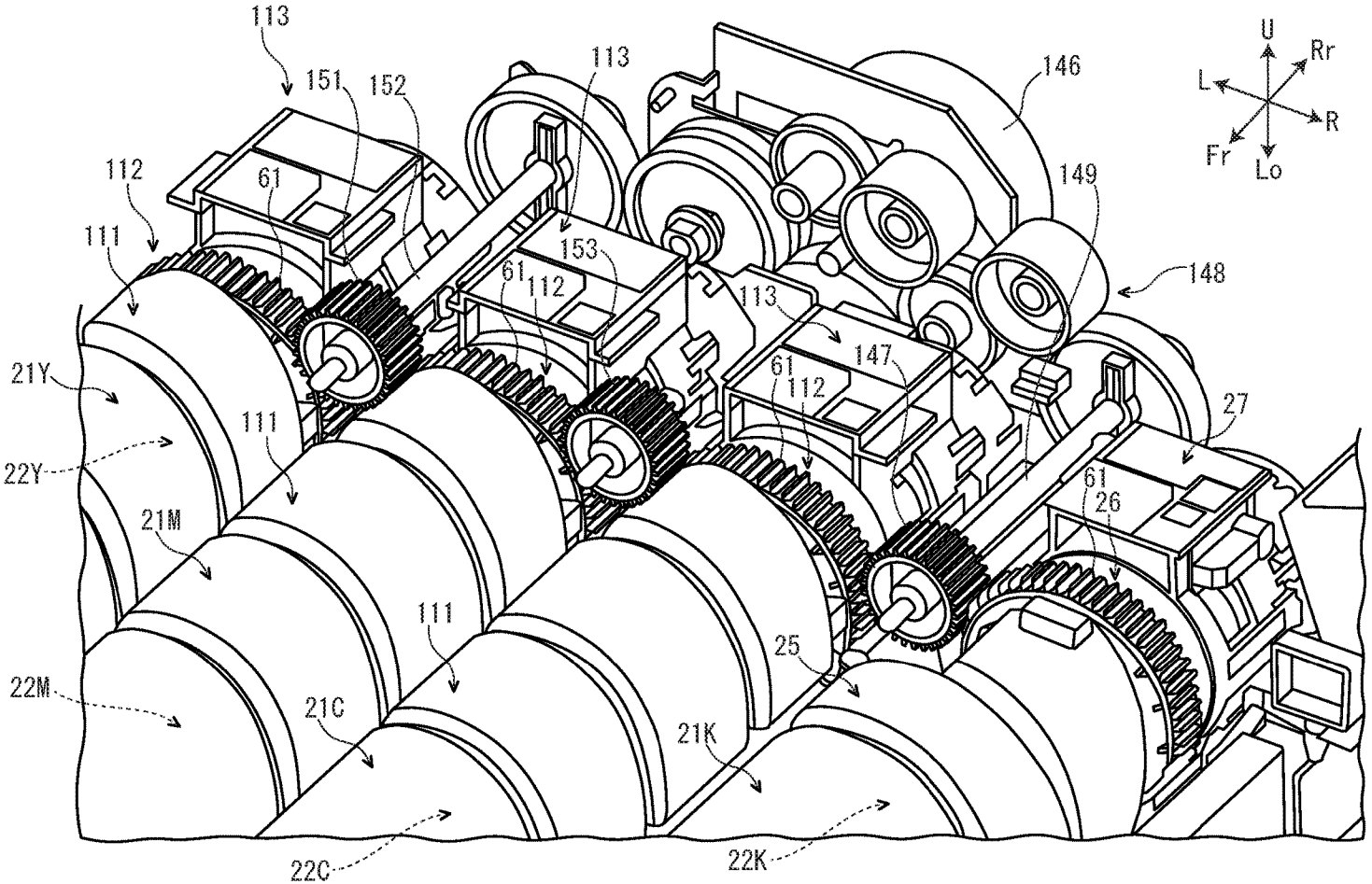
FIG. 15 is a perspective view showing a rear part of each toner container and a rear part of each toner supplying attachment part according to the embodiment of the present disclosure.

As shown in FIG. 15 and other figures, a driving source 146 composed of a motor or the like is arranged at a rear side of the toner supplying attachment parts 22K, 22C, 22M, 22Y. A first driving gear 147 is arranged between the toner supplying attachment part 22K and the toner supplying attachment part 22C. The first driving gear 147 is connected with the driving source 146 via a gear train 148 and a first driving shaft 149. A second driving gear 151 is arranged between the toner supplying attachment part 22M and the toner supplying attachment part 22Y. The second driving gear 151 is connected with the driving source 146 via the gear train 148 and a second driving shaft 152. An idle gear 153 is arranged between the toner supplying attachment part 22C and the toner supplying attachment part 22M.

Next, the waste toner bottle 23 will be described.

Figure 16:
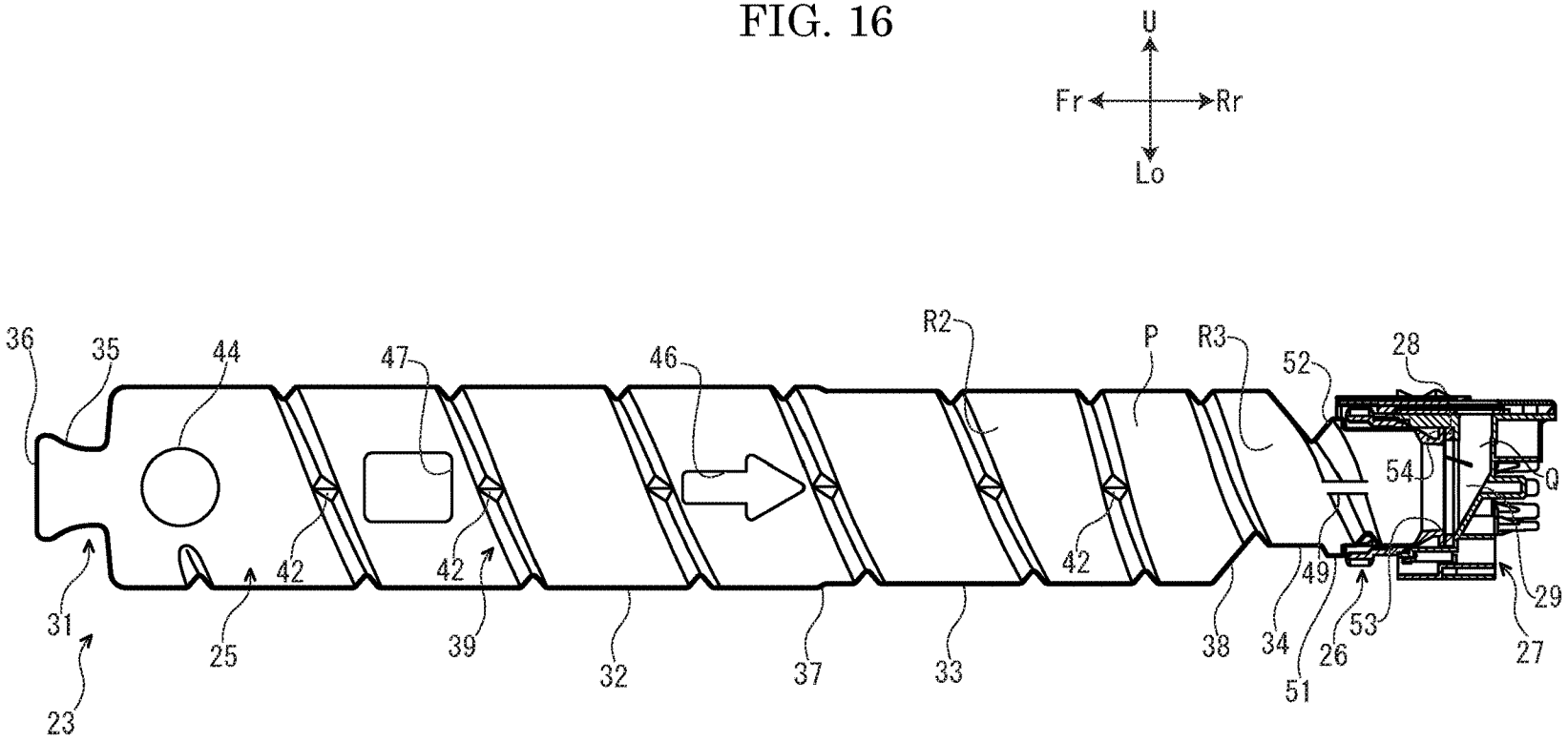
FIG. 16 is a sectional view showing a waste toner bottle according to the embodiment of the present disclosure.

As shown in FIG. 16 and other figures, the waste toner bottle 23 is formed by reversing upper and lower sides of the toner container 21K. A configuration of the waste toner bottle 23 is the same as the configuration of the toner container 21K and therefore will not be described.

Next, the waste toner collecting attachment part 24 will be described.

Figure 17:
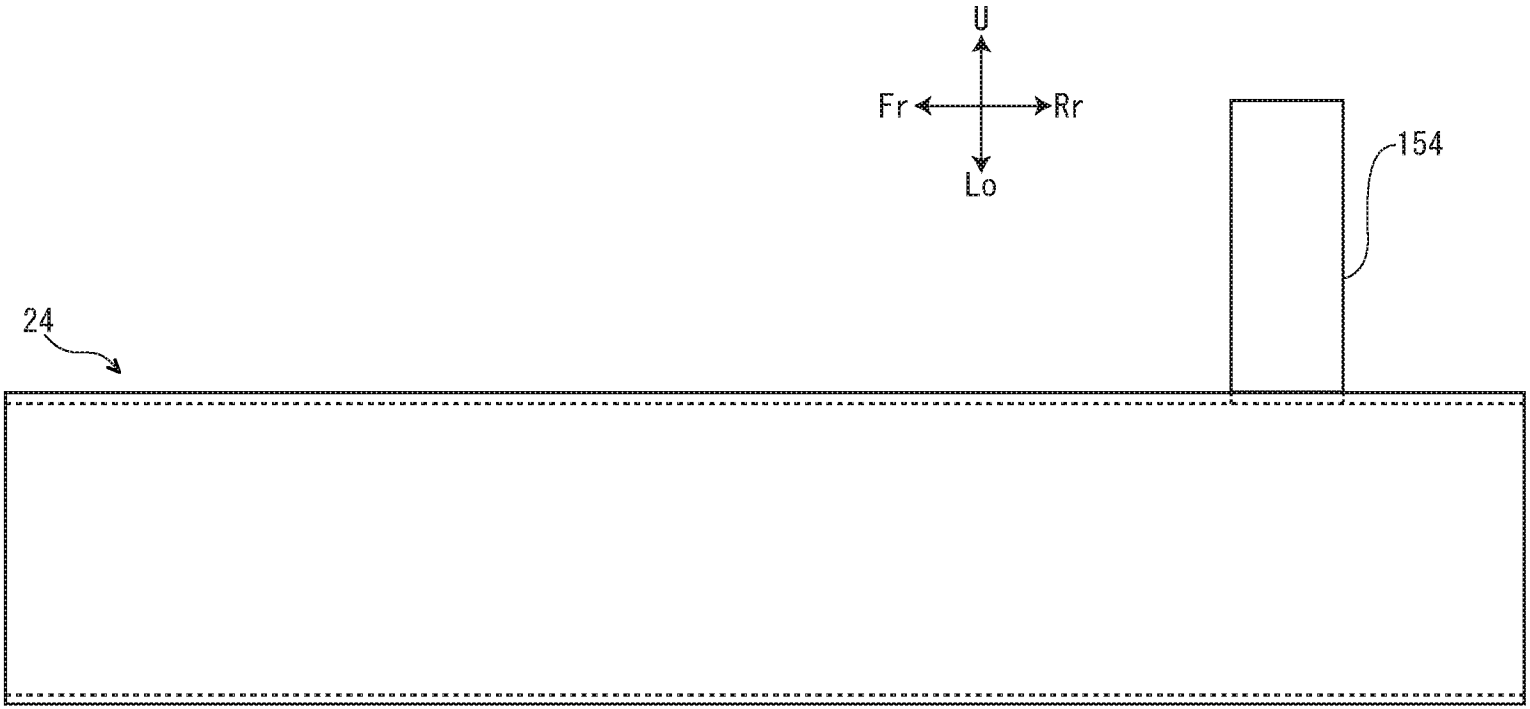
FIG. 17 is a side view showing a waste toner collecting attachment part according to the embodiment of the present disclosure.

As shown in FIG. 17 and other figures, the waste toner collecting attachment part 24 is formed in a tubular shape extending in the front and rear direction. A disposal tube 154 extending along the upper and lower direction is arranged at a rear upper side of the waste toner collecting attachment part 24.

An operation of attaching the toner containers 21K, 21C, 21M, 21Y to the toner supplying attachment parts 22K, 22C, 22M, 22Y, respectively, in the MFP 1 configured as mentioned above will be described. Incidentally, the operation of attaching each toner container 21K, 21C, 21M, 21Y is the same, and therefore only the operation of attaching the toner container 21K to the toner supplying attachment part 22K will be described and the operations of attaching the toner containers 21C, 21M, 21Y to the toner supplying attachment parts 22C, 22M, 22Y, respectively, will not be described.

The toner container 21K is inserted into the toner supplying attachment part 22K from the front side to the rear side as shown in FIG. 2 and other figures, when the toner container 21K is attached to the toner supplying attachment part 22K.

Figure 18:
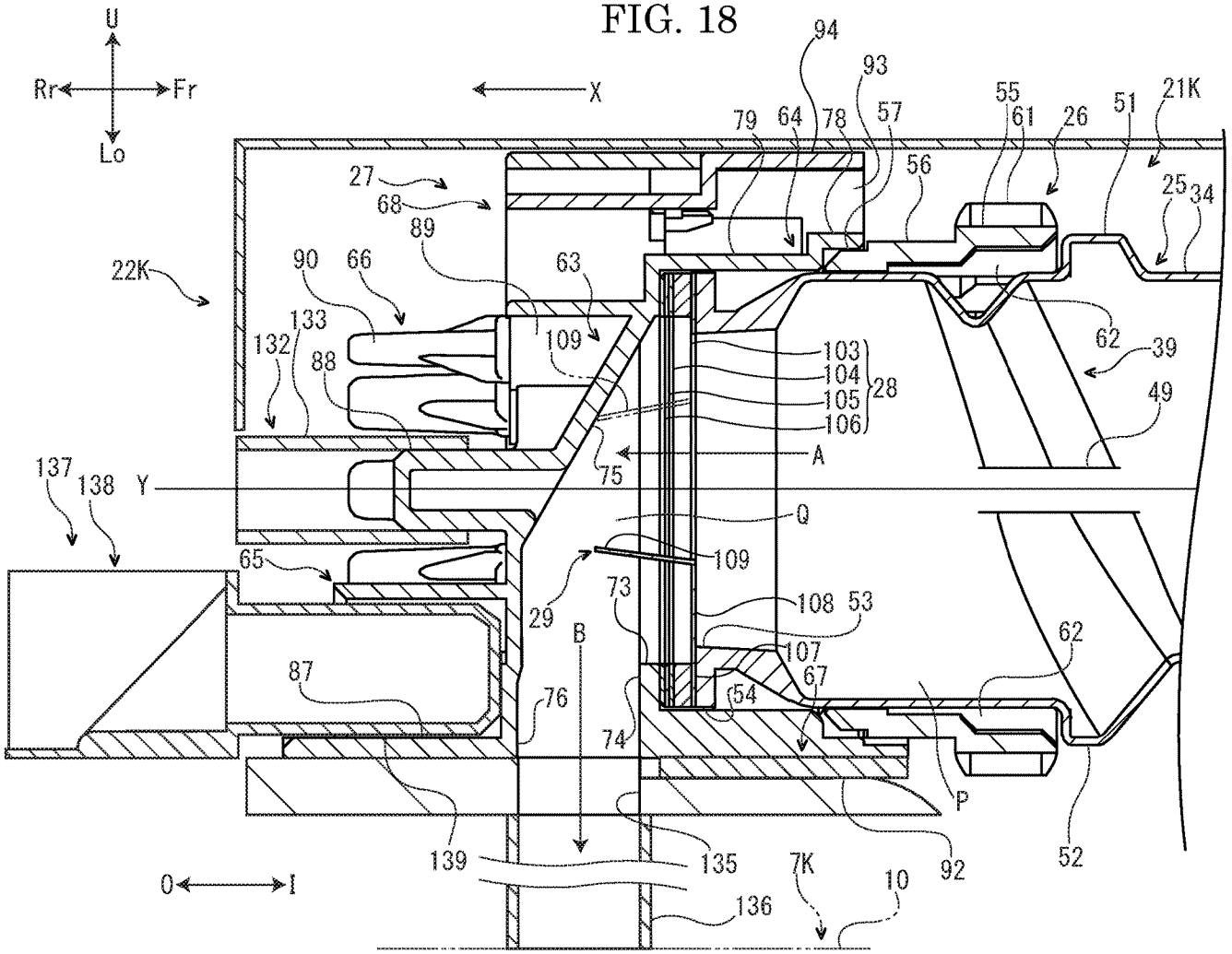
FIG. 18 is a sectional view showing a state that the black toner container is attached to the black toner supplying attachment part, in the MFP according to the embodiment of the present disclosure.

As shown in FIG. 18, when the toner container 21K is further inserted into the toner supplying attachment part 22K in this state and the toner container 21K is attached to the toner supplying attachment part 22K, the main body part 63 of the cover 27 presses the boss 139 in a state that the recess part 87 formed at the engagement cylinder part 65 of the cover 27 of the toner container 21K and the boss 139 of the attachment part side shutter 137 of the toner supplying attachment part 22K engage with each other. This press moves the attachment part side shutter 137 from the closing position to the opening position so as to open the toner supplying port 135 of the toner supplying attachment part 22K.

Further, when the toner container 21K is attached to the toner supplying attachment part 22K as mentioned above, the movable piece 92 of the cover side shutter 67 arranged at the cover 27 of the toner container 21K moves from the closing position to the opening position so as to open the toner discharging port 76 of the main body part 63 of the cover 27. Therefore, the communication space Q of the main body part 63 communicates with an inside space of the supply tube 136.

Further, when the toner container 21K is attached to the toner supplying attachment part 22K as mentioned above, the fitting protrusion 88 formed at the cover side restricting part 66 of the cover 27 of the toner container 21K fits to the fitted part 133 formed at the attachment part side restricting part 132 of the toner supplying attachment part 22K. Incidentally, when a place of destination of the MFP main body 2 and a place of destination of the toner container 21K match, each restricting plate 90 arranged at the cover side restricting part 66 of the cover 27 and each restricting piece 134 (see FIG. 14 and other figures) arranged at the attachment part side restricting part 132 of the toner supplying attachment part 22K do not interfere with each other so that attachment of the toner container 21K to the toner supplying attachment part 22K is allowed. Meanwhile, when the place of destination of the MFP main body 2 and the place of destination of the toner container 21K do not match, each restricting plate 90 arranged at the cover side restricting part 66 of the cover 27 and each restricting piece 134 arranged at the attachment part side restricting part 132 of the toner supplying attachment part 22K interfere with each other so that attachment of the toner container 21K to the toner supplying attachment part 22K is restricted.

Further, when the toner container 21K is attached to the toner supplying attachment part 22K as mentioned above, the transmission gear 61 of the transmission member 26 of the toner container 21K is directly connected with the first driving gear 147 as shown in FIG. 15 and other figures.

Incidentally, when the toner containers 21C, 21M, 21Y are attached to the toner supplying attachment parts 22C, 22M, 22Y, respectively, the transmission gears 61 of the transmission members 112 of the toner containers 21M, 21Y are directly connected with the second driving gear 151. Further, the transmission gears 61 of the transmission members 112 of the toner containers 21C, 21M are connected with the idle gear 153. Thus, the transmission gear 61 of the transmission member 112 of the toner container 21C is connected with the second driving gear 151 via the transmission gear 61 of the transmission member 112 of the toner container 21M and the idle gear 153.

Next, an operation of supplying a toner from the toner container 21K to the developing device 10 of the image forming part 7K in the MFP 1 configured as mentioned above will be described.

As shown in FIG. 15 and other figures, the driving source 146 is driven in a state that the toner container 21K is attached to the toner supplying attachment part 22K when the toner is supplied from the toner container 21K to the developing device 10 of the image forming part 7K. When the driving source 146 is driven in this way, rotation driving force of the driving source 146 is transmitted to the first driving gear 147 via the gear train 148 and the first driving shaft 149 so as to rotate the first driving gear 147. That is, the first driving gear 147 rotates by the rotation driving force of the driving source 146.

When the first driving gear 147 rotates in this way, the rotation of the first driving gear 147 is transmitted to the transmission member 26 of the toner container 21K so as to rotate the transmission member 26. When the transmission member 26 rotates in this way, the case main body 25 of the toner container 21K rotates integrally with the transmission member 26 in accordance with this rotation. That is, the transmission member 26 transmits the rotation driving force of the driving source 146 to the case main body 25.

When the case main body 25 of the toner container 21K rotates as mentioned above, the agitating member 29 (see FIG. 18 and other figures) of the toner container 21K rotates integrally with the case main body 25. Meanwhile, the cover 27 and the seal member 28 of the toner container 21K do not rotate when the case main body 25 rotates, and maintains a rotation stop state. Therefore, the case main body 25 and the agitating member 29 relatively rotate with respect to the cover 27 and the seal member 28, and the fixed part 107 of the agitating member 29 slides with respect to the elastic layer 103 of the seal member 28.

Further, when the case main body 25 of the toner container 21K rotates as mentioned above, the toner in the case main body 25 is conveyed by the conveying rib 39 of the case main body 25 from the front side to the rear side as indicated by an arrow A in FIG. 18 and is discharged from the case main body 25 via the opening part 53. The toner discharged from the case main body 25 via the opening part 53 in this way is introduced to the communication space Q of the main body part 63 of the cover 27 via the toner introducing port 73. The toner introduced to the communication space Q in this way is agitated by the inserted part 109 of the agitating member 29 which rotates integrally with the case main body 25, and is discharged from the communication space Q via the toner discharging port 76 of the main body part 63 as indicated by an arrow B in FIG. 18. The toner discharged from the communication space Q via the toner discharging port 76 in this way is introduced to the supply tube 136 via the toner supplying port 135 of the toner supplying attachment part 22K, and is supplied from the supply tube 136 to the developing device 10 of the image forming part 7K.

Next, an operation of supplying a toner from the toner containers 21C, 21M, 21Y to the developing devices 10 of the image forming parts 7C, 7M, 7Y in the MFP 1 configured as mentioned above will be described.

As shown in FIG. 15 and other figures, the driving source 146 is driven in a state that the toner containers 21C, 21M, 21Y are attached to the toner supplying attachment parts 22C, 22M, 22Y, respectively, when the toner is supplied from the toner containers 21C, 21M, 21Y to the developing devices 10 of the image forming parts 7C, 7M, 7Y, respectively. When the driving source 146 is driven in this way, the rotation driving force of the driving source 146 is transmitted to the second driving gear 151 via the gear train 148 and the second driving shaft 152 so as to rotate the second driving gear 151. That is, the second driving gear 151 rotates by the rotation driving force of the driving source 146.

When the second driving gear 151 rotates in this way, the rotation of the second driving gear 151 is transmitted to the transmission members 112 of the toner containers 21M, 21Y so as to rotate the transmission members 112 of the toner containers 21M, 21Y. Further, the rotation of the second driving gear 151 is transmitted to the transmission member 112 of the toner container 21C via the transmission member 112 of the toner container 21M and the idle gear 153 so as to rotate the transmission member 112 of the toner container 21C. The other functions are the same as those of the operation of supplying the toner from the toner container 21K to the developing device 10 of the image forming part 7K and therefore will not be described.

Next, an operation of collecting a waste toner from the intermediate transfer belt 5 and the photosensitive drum 8 of each image forming part 7K, 7C, 7M, 7Y by the waste toner bottle 23 in the MFP 1 configured as mentioned above will be described.

Figure 19:
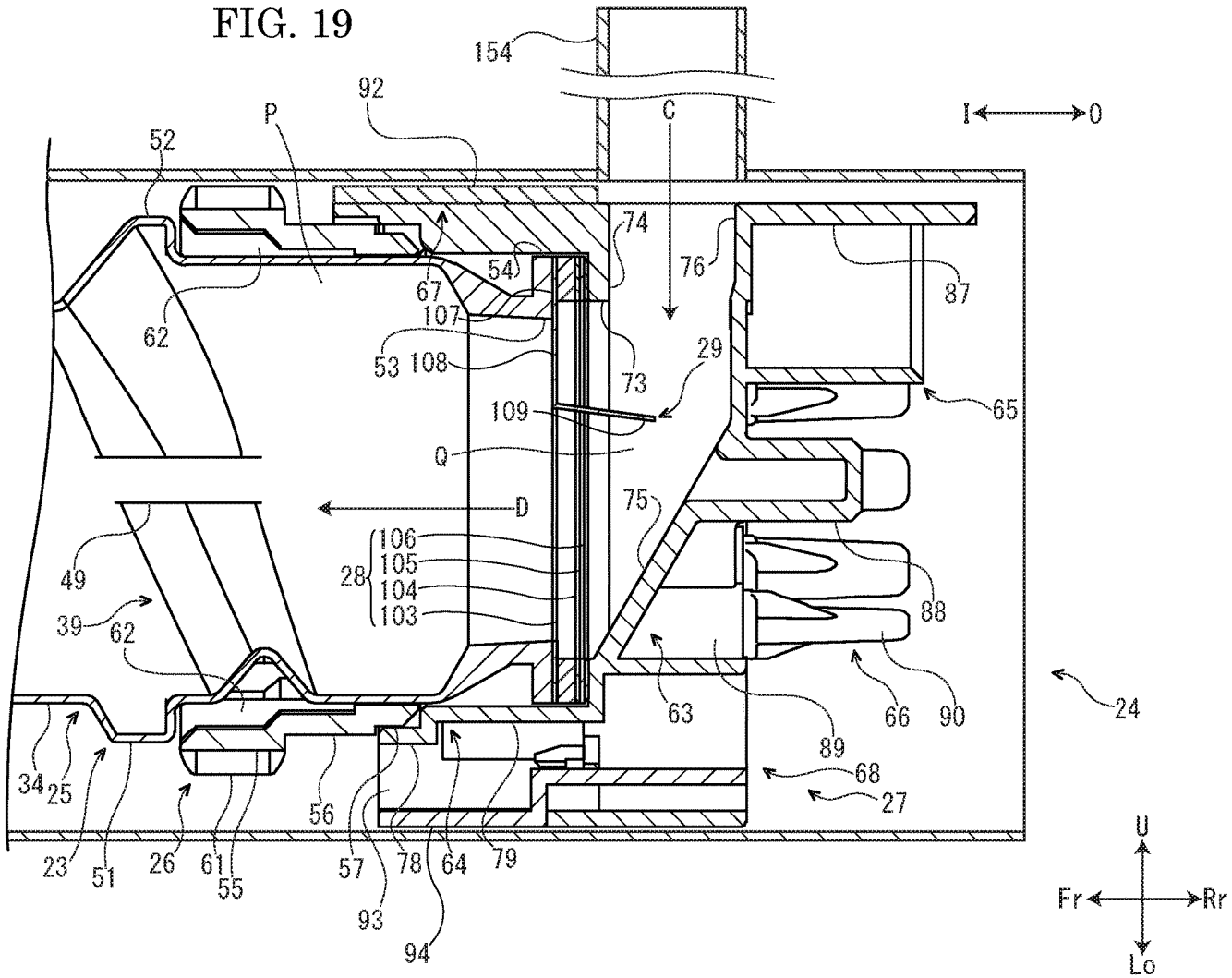
FIG. 19 is a sectional view showing a state that the waste toner bottle is attached to the waste toner collecting attachment part, in the MFP according to the embodiment of the present disclosure.

As shown in FIG. 19, when the waste toner is collected, the transmission member 26 of the waste toner bottle 23 is rotated in a state that the waste toner bottle 23 is attached to the waste toner collecting attachment part 24. When the transmission member 26 rotates in this way, the case main body 25 of the waste toner bottle 23 rotates integrally with the transmission member 26, and the agitating member 29 of the waste toner bottle 23 rotates integrally with the case main body 25.

Further, when the waste toner is collected, the cleaning mechanism 6 collects the waste toner from the intermediate transfer belt 5 and the cleaning device 12 of each image forming part 7K, 7C, 7M, 7Y collects the waste toner from the photosensitive drum 8. The waste toner collected by the cleaning mechanism 6 and the cleaning device 12 in this way is conveyed to the disposal tube 154 via a disposal duct (not shown). The waste toner conveyed to the disposal tube 154 in this way is introduced from the disposal tube 154 to the communication space Q of the cover 27 of the waste toner bottle 23 as indicated by an arrow C in FIG. 19. The waste toner introduced to the communication space Q of the cover 27 in this way is agitated by the agitating member 29 which rotates integrally with the case main body 25, and is introduced from the communication space Q of the cover 27 to the toner containing space P of the case main body 25. The waste toner introduced to the toner containing space P of the case main body 25 in this way is conveyed from the rear side to the front side by the conveying rib 39 of the case main body 25 as indicated by an arrow D in FIG. 19, and is contained in the case main body 25.

Incidentally, in the present embodiment, after the black toner contained in the toner containing space P of the case main body 25 of the toner container 21K becomes empty, upper and lower sides of the toner container 21K are reversed, so that the toner container 21K is used as the waste toner bottle 23.

Hereinafter, effects exhibited by the MFP 1 according to the present embodiment and modifications of the MFP 1 according to the present embodiment will be further described in detail. Incidentally, the common effects and modifications of the toner containers 21K, 21C, 21M, 21Y will be described only regarding the toner container 21K, and the effects and modifications of the toner containers 21C, 21M, 21Y will be omitted.

The toner container 21K according to the present embodiment includes the agitating member 29 which rotates integrally with the case main body 25 and agitates the toner in the communication space Q of the cover 27. By applying such a configuration, the agitating member 29 agitates the toner in the communication space Q of the cover 27, so that it is possible to prevent the toner from congealing in the communication space Q of the cover 27.

According to the present embodiment in particular, the toner in the toner containing space P of the case main body 25 is conveyed by the conveying rib 39 in accordance with the rotation of the case main body 25 of the toner container 21K, so that the toner hardly congeals in the toner containing space P of the case main body 25. Meanwhile, the cover 27 of the toner container 21K maintains a rotation stop state when the case main body 25 rotates, and therefore the toner is likely to congeal in the communication space Q of the cover 27. Hence, it is highly important that the agitating member 29 agitates the toner in the communication space Q of the cover 27 as mentioned above to prevent the toner from congealing in the communication space Q of the cover 27.

According to the present embodiment in particular, when the agitating member 29 of the toner container 21K rotates, the inserted part 109 of the agitating member 29 comes into contact with a front face (inner face) of the inclined wall part 75 of the main body part 63 of the cover 27 (see a two-dot chain line in FIG. 18). Consequently, it is possible to scrape the toner sticking to the front face of the inclined wall part 75 by the inserted part 109 of the agitating member 29, and it is possible to more effectively prevent the toner from congealing in the communication space Q of the cover 27.

Further, the opening part 53 of the case main body 25 of the toner container 21K is formed at the rear end part of the case main body 25, and the agitating member 29 includes the fixed part 107 which is fixed to the rear end part of the case main body 25 and the inserted part 109 which protrudes toward the rear side (the side of the communication space Q) with respect to the fixed part 107 and whose distal end part is inserted into the communication space Q. By applying such a configuration, it is possible to effectively agitate the toner in the communication space Q of the cover 27.

Further, the agitating member 29 of the toner container 21K is composed of a material having a lower friction coefficient than that of the case main body 25, and the fixed part 107 of the agitating member 29 is interposed between the rear end part of the case main body and the seal member 28. By applying such a configuration, it is possible to enhance sliding performance of the case main body 25 and suppress friction of the seal member 28 compared to a case where the case main body 25 and the seal member 28 come into direct contact with each other.

The agitating member 29 of the toner container 21K includes the extending part 108 which extends from the fixed part 107 toward the inside in the radial direction, and the inserted part 109 extends from the inside end part in the radial direction of the extending part 108 toward the rear side (the side of the communication space Q). By applying such a configuration, it is possible to locate the inserted part 109 close to the inside in the radial direction compared to a case where the inserted part 109 extends from the fixed part 107 toward the rear side (the side of the communication space Q). According to this, it is possible to prevent the inserted part 109 and the cover 27 from being caught up by each other.

Further, the fixing face H on which the rear end part of the case main body 25 of the toner container 21K and the fixed part 107 are fixed is vertical to the rotation axis line Y. By applying such a configuration, it is possible to easily fix the fixed part 107 to the rear end part of the case main body 25.

Further, the distal end part of the inserted part 109 formed at the agitating member 29 of the toner container 21K is located right above the toner discharging port 76 formed in the main body part 63 of the cover 27. By applying such a configuration, the toner agitated by the agitating member 29 in the communication space Q drops by the weight of the toner, and is discharged from the toner discharging port 76. Consequently, it is possible to more effectively discharge the toner in the communication space Q.

Figure 20:
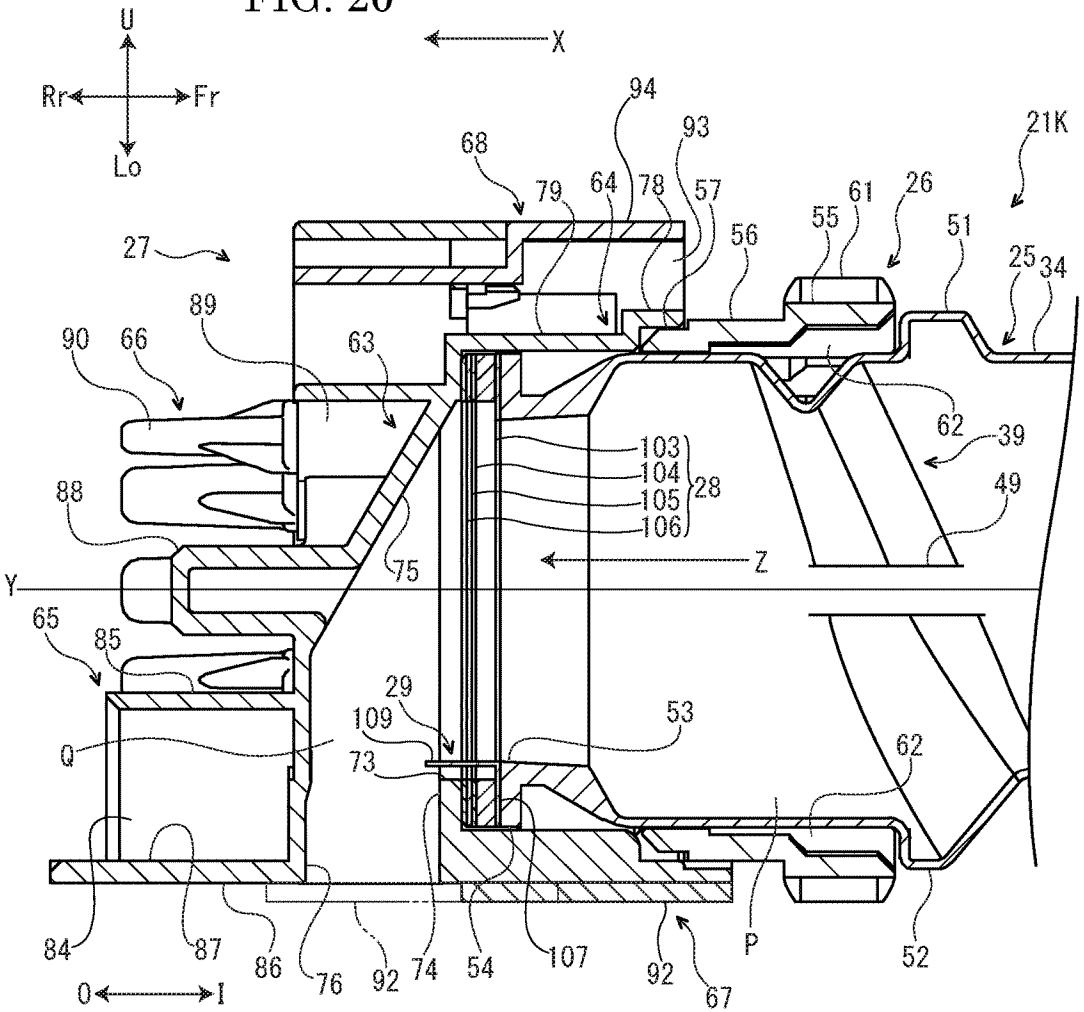
FIG. 20 is a sectional view showing a rear part of a black toner container according to another embodiment of the present disclosure.

In the present embodiment, the inserted part 109 of the agitating member 29 of the toner container 21K extends from the inside end part in the radial direction of the extending part 108 toward the rear side (the side of the communication space Q). In other embodiments, as shown in FIG. 20, the inserted part 109 of the agitating member 29 of the toner container 21K may extend from the fixed part 107 toward the rear side (the side of the communication space Q). By applying such a configuration, it is possible to simplify the structure of the agitating member 29, compared to a case where the extending part 108 is arranged between the fixed part 107 and the inserted part 109.

In the present embodiment, the inserted part 109 is bent at an obtuse angle from the extending part 108. In other embodiments, as shown in FIG. 20, the inserted part 109 may be bent orthogonally from the fixed part 107 or the extending part 108. Further, in still other embodiments, the inserted part 109 may be bent at an acute angle from the fixed part 107 or the extending part 108.

In the present embodiment, when the agitating member 29 of the toner container 21K rotates, the inserted part 109 of the agitating member 29 comes into contact with the inclined wall part 75 of the main body part 63 of the cover 27. In other embodiments, when the agitating member 29 of the toner container 21K rotates, the inserted part 109 of the agitating member 29 may not come into contact with the inclined wall part 75 of the main body part 63 of the cover 27. By applying such a configuration, it is possible to prevent the inserted part 109 of the agitating member 29 and the inclined wall part 75 from being caught up by each other.

In the present embodiment, a single inserted part 109 is arranged at the agitating member 29. In other embodiments, a plurality of inserted parts 109 may be arranged at the agitating member 29.

In the present embodiment, the agitating member 29 includes the inserted part 109 at least a part of which is inserted into the communication space Q. In other embodiments, the agitating member 29 may include both of the inserted part 109 at least a part of which is inserted into the communication space Q and an inserted part (not shown) at least a part of which is inserted into the toner containing space P.

In the present embodiment, the four right base parts 89 of the eight base parts 89 of the toner container 21K are provided with the restricting plates 90. On the other hand, as described above, a combination of the base parts 89 provided with the restricting plates 90 is different, depending on the place of destination of the toner container 21K. Accordingly, in other embodiments, four left base parts 89 or four upper base parts 89 of the eight base parts 89 may be provided with the restricting plates 90, for example. In addition, in other embodiments, the number of the restricting plates 90 may not be four. As described above, the combination of the base parts 89 provided with the restricting plates 90 and the number of the restricting plates 90 may be decided freely, depending on the place of destination of the toner container 21K.

In the present embodiment, the configuration of the present disclosure is applied to the MFP 1. In other embodiments, the configuration of the present disclosure may be applied to an image forming apparatus other than the MFP 1, such as a printer, a copying machine, a facsimile, or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body configured to contain a toner and to rotate around a rotation axis line;

a cover configured to cover an opening part arranged at the case main body and to maintain a rotation stop state when the case main body rotates, the cover having a communication space which communicates with an inside space of the case main body via the opening part;

an agitating member configured to rotate integrally with the case main body and to agitate the toner in the communication space; and a seal member fixed to the cover and configured to maintain a rotation stop state when the case main body rotates, wherein the opening part is formed in a circular shape and arranged at one end part in a direction of the rotation axis line of the case main body, and an annular flange part protruding toward an outside in a radial direction is formed at the one end part in the direction of the rotation axis line of the case main body and at an outer circumference of the opening part, wherein the agitating member includes:

a fixed part interposed between the one end part in the direction of the rotation axis line of the case main body and the seal member; and an inserted part configured to protrude toward a side of the communication space with respect to the fixed part, at least a part of the inserted part being inserted into the communication space, and wherein an inside face in the direction of the rotation axis line of the fixed part is fixed to the one end part in the direction of the rotation axis line of the case main body, and an outside face in the direction of the rotation axis line of the fixed part comes into contact with an inside face in the direction of the rotation axis line of the seal member, wherein the fixed part is formed in an annular shape without any opening in a circumferential direction, and wherein the agitating member is composed of a resin film.

2. The toner case according to claim 1, wherein the agitating member further includes an extending part configured to extend from the fixed part toward an inside in a radial direction, and the inserted part is configured to extend from an inside end part in the radial direction of the extending part toward the side of the communication space.

3. The toner case according to claim 1, wherein the inserted part is configured to extend from the fixed part toward the side of the communication space.

4. The toner case according to claim 1, wherein a fixing face on which the one end part in the direction of the rotation axis line of the case main body and the fixed part are fixed is vertical to the rotation axis line.

5. The toner case according to claim 1, wherein the cover has a toner discharging port through which the toner is discharged from the communication space, and a distal end part of the agitating member is located right above the toner discharging port.

6. The toner case according to claim 1, wherein a distal end part of the agitating member is curved in an arc shape.

7. The toner case according to claim 1, wherein, when the agitating member rotates, the agitating member comes into contact with an inner face of the cover and scrapes the toner sticking to the inner face of the cover.

8. An image forming apparatus comprising:

the toner case according to claim 1; and an attachment part to which the toner case is attached.

* * * * *